US010675890B2

(12) United States Patent
Motosugi et al.

(10) Patent No.: US 10,675,890 B2
(45) Date of Patent: Jun. 9, 2020

(54) DRYING UNIT AND EJECTION DEVICE

(71) Applicant: FUJI XEROX CO., LTD., Tokyo (JP)

(72) Inventors: Yukari Motosugi, Ebina (JP); Shigeyuki Sakaki, Ebina (JP); Hiroyuki Tsukuni, Ebina (JP); Akira Sakamoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/102,791

(22) Filed: Aug. 14, 2018

(65) Prior Publication Data

US 2019/0291468 A1 Sep. 26, 2019

(30) Foreign Application Priority Data

Mar. 23, 2018 (JP) ..... 2018-056980

(51) Int. Cl.
*B41J 11/00* (2006.01)
*B41M 7/00* (2006.01)

(52) U.S. Cl.
CPC ..... *B41J 11/002* (2013.01); *B41M 7/0081* (2013.01)

(58) Field of Classification Search
CPC ..... B41J 11/002; B41M 7/0081
See application file for complete search history.

(56) References Cited

U.S. PATENT DOCUMENTS 10,245,851 B2 * 4/2019 Nakano ..... B41M 7/00
2006/0290760 A1 * 12/2006 German ..... B41J 11/002 347/102
2014/0085389 A1 * 3/2014 Miyabayashi ..... B41J 11/002 347/102
2015/0251449 A1 * 9/2015 Isozaki ..... B41J 11/002 347/102
2016/0167398 A1 * 6/2016 Motosugi ..... B41J 2/14104 347/16
2017/0087874 A1 3/2017 Maida
2018/0001667 A1 1/2018 Ikeda et al.

FOREIGN PATENT DOCUMENTS

JP 2014-83762 5/2014
JP 2017-65160 4/2017
JP 2018-1556 1/2018

OTHER PUBLICATIONS

Abstract and machine translation of JP 2014-83762.

* cited by examiner

*Primary Examiner* — Yaovi M Ameh
(74) *Attorney, Agent, or Firm* — Fildes & Outland, P.C.

(57) ABSTRACT

A drying unit includes: a first irradiation device that includes plural first irradiation arrays each having plural laser elements disposed along a feeding direction of a recording medium to which liquid droplets have been ejected and which is being fed, the recording medium being irradiated with laser light by the laser elements, the first irradiation arrays being disposed side by side in a cross direction crossing the feeding direction, driving of the first irradiation device being controlled for each of the first irradiation arrays; and a second irradiation device that is provided on an upstream side or a downstream side in the feeding direction with respect to the first irradiation device, as defined herein.

19 Claims, 19 Drawing Sheets

FIG. 22

| PAPER | NIJ55 | NIJ70 | NIJ35 | OKT63 | OKT90 | OKT110 | OKT135 |
|---|---|---|---|---|---|---|---|
| TRANSMISSIVITY [%] | 17.4 | 14.2 | 7.2 | 21.4 | 15.4 | 11.4 | 8.8 |
| REFLECTIVITY [%] | 77.6 | 82.6 | 90.7 | 71.8 | 79.7 | 84.2 | 87.5 |
| ABSORPTIVITY [%] | 5.0 | 3.1 | 2.1 | 6.8 | 4.9 | 4.4 | 3.7 |

FIG. 23

| EVALUATION | EXEMPLARY EMBODIMENT (FIG. 2) | FIRST MODIFIED EXAMPLE (FIG. 19) | FIRST COMPARATIVE EXAMPLE (FIG. 7) | SECOND COMPARATIVE EXAMPLE (FIG. 12) |
|---|---|---|---|---|
| WRINKLES IN IMAGE PORTION AND NON-IMAGE PORTION | A | A | B | B |
| IMAGE DENSITY IN LOW-RATE MODE | A | B | B | B |

DRYING UNIT AND EJECTION DEVICE

CROSS-REFERENCE TO RELATED APPLICATIONS

This application is based on and claims priority under 35 USC 119 from Japanese Patent Application No. 2018-056980 filed on Mar. 23, 2018.

BACKGROUND

1. Technical Field

The present invention relates to a drying unit, and an ejection device.

2. Related Art

An inkjet recording apparatus according to JP-A-2017-65160 includes an ink droplet drying portion in which plural drying units are provided along a feeding direction of paper. The drying units can dry liquid droplets ejected to the paper. On this occasion, each of the drying units can change drying intensity in a cross direction crossing the feeding direction of the paper. The drying intensity of each drying unit is controlled by a control unit in accordance with the amount of liquid droplets imparted to each of plural divisions to which the paper is divided in the feeding direction and the cross direction.

In a laser drying unit according to JP-A-2018-1556, laser element groups each including plural laser elements disposed along a feeding direction of paper are aligned as laser element blocks respectively, and each laser element block is driven in a lump by a laser driving portion.

SUMMARY

Assume that an irradiation device includes plural irradiation arrays in each of which plural laser elements for irradiating a recording medium with laser light are disposed along a feeding direction of the recording medium, and the irradiation arrays are disposed side by side in a cross direction crossing the feeding direction so that driving the irradiation device is controlled for each irradiation array. When the irradiation device is used, the laser elements along the feeding direction in each irradiation array as a unit to be driven have one and the same irradiation intensity. Accordingly, for example, when an image portion formed by liquid droplets and a non-image portion are mixed in an irradiation range of an irradiation array extending along the feeding direction, unevenness in drying may be produced to generate wrinkles in the recording medium.

Aspects of non-limiting embodiments of the present disclosure relate to suppress occurrence of wrinkles in a recording medium in comparison with a configuration including only an irradiation device in which plural irradiation arrays each including plural laser elements disposed along a feeding direction of the recording medium so as to irradiate the recording medium with laser light are disposed side by side in a cross direction crossing the feeding direction, and driving the irradiation device is controlled for each irradiation array.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a drying unit comprising: a first irradiation device that includes plural first irradiation arrays each having plural laser elements disposed along a feeding direction of a recording medium to which liquid droplets have been ejected and which is being fed, the recording medium being irradiated with laser light by the laser elements, the first irradiation arrays being disposed side by side in a cross direction crossing the feeding direction, driving of the first irradiation device being controlled for each of the first irradiation arrays; and a second irradiation device that is provided on an upstream side or a downstream side in the feeding direction with respect to the first irradiation device, the second irradiation device including plural second irradiation arrays each having plural laser elements disposed along the cross direction, the recording medium being irradiated with laser light by the laser elements, the second irradiation arrays being disposed side by side in the feeding direction, driving of the second irradiation device being controlled for each of the second irradiation arrays.

BRIEF DESCRIPTION OF THE DRAWINGS

Exemplary embodiments of the present invention will be described in detail based on the following figures, wherein:

FIG. 22 is a table showing transmissivity, reflectivity and absorptivity in various kinds of paper for a peak wavelength of laser light; and FIG. 23 is a table showing evaluation results.

DESCRIPTION OF REFERENCE NUMERALS AND SIGNS

Figure 1:
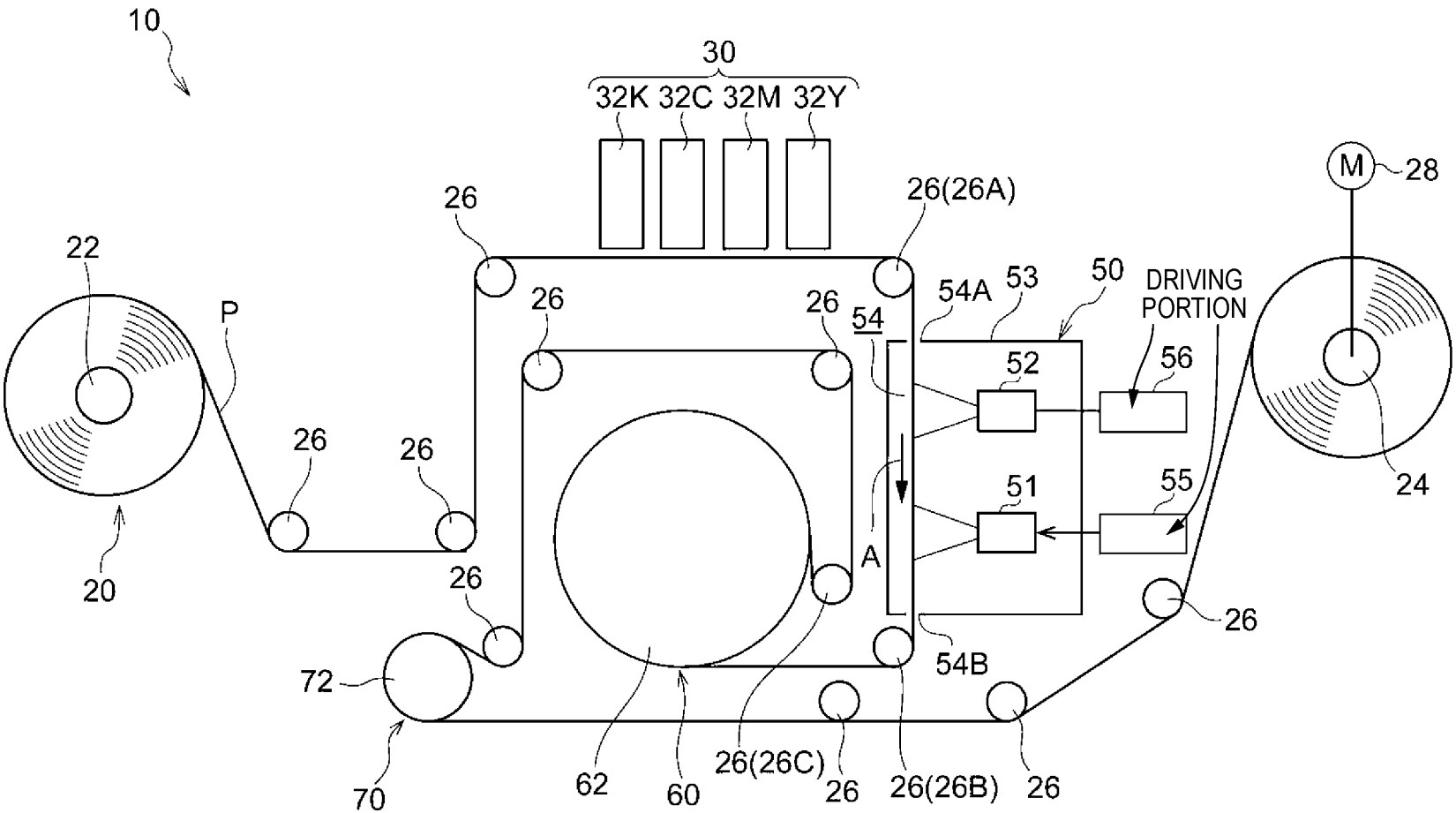
FIG. 1 is a schematic view illustrating a configuration of an inkjet recording apparatus according to an exemplary embodiment of the present invention.

10 inkjet recording apparatus (example of ejection device)
20 feed mechanism (example of feeding portion)
30 ejection unit (example of ejection portion)
42 laser element
44 irradiation array
50 first drying portion (example of drying unit)
51 first irradiation device
52 second irradiation device
82 laser element
84 irradiation array
P continuous paper (example of recording medium)

DETAILED DESCRIPTION

An example of an exemplary embodiment of the present invention will be described below with reference to the drawings.

(Inkjet Recording Apparatus 10)

An inkjet recording apparatus 10 will be described. FIG. 1 is a schematic view illustrating the configuration of the inkjet recording apparatus 10.

The inkjet recording apparatus 10 is an example of an ejection device that ejects liquid droplets. Specifically, the inkjet recording apparatus 10 is an apparatus that ejects ink droplets onto a recording medium. More specifically, the inkjet recording apparatus 10 is an apparatus that ejects ink droplets onto continuous paper P (an example of the recording medium) to thereby form an image on the continuous paper P. To say other words, the inkjet recording apparatus 10 may be regarded as an example of an image forming apparatus that forms an image on the recording medium.

As illustrated in FIG. 1, the inkjet recording apparatus 10 has a feed mechanism 20, an ejection unit 30 (an example of an ejection portion), a first drying portion 50, a second drying portion 60, and a cooling portion 70. Description will be made below about ink (liquid) and the continuous paper P for use in the inkjet recording apparatus 10, and the respective portions (the feed mechanism 20, the ejection unit 30, the first drying portion 50, the second drying portion 60, and the cooling portion 70) of the inkjet recording apparatus 10.

(Ink)

For example, aqueous ink is used as the ink for use in the inkjet recording apparatus 10. The aqueous ink contains water, a coloring agent, an infrared absorbent, and other additives. A pigment or a dye is, for example, used as the coloring agent. The infrared absorbent does not have to be added to an ink that absorbs laser light, such as black (K) ink.

The ink has a property of permeating the recording medium. Incidentally, any ink may be used as long as it has a property of permeating the recording medium.

(Continuous Paper P)

The continuous paper P for use in the inkjet recording apparatus 10 is a long recording medium having length in the feeding direction thereof. Paper is used for the continuous paper P. Examples of the paper may include coated paper, uncoated paper (plain paper), etc.

The recording medium has a property of being permeated by the ink. The recording medium may be a sheet (cut paper). Any medium may be used as long as it has a property of being permeated by the ink.

(Feed Mechanism 20)

The feed mechanism 20 illustrated in FIG. 1 is an example of a feeding portion that feeds the recording medium. Specifically, the feed mechanism 20 is a mechanism that feeds the continuous paper P. More specifically, the feed mechanism 20 has an unwind roll 22, a take-up roll 24, and a plurality of wind rolls 26, as shown in FIG. 1.

The unwind roll 22 is a roll that unwinds the continuous paper P. The continuous paper P is wound around the unwind roll 22 in advance. The unwind roll 22 rotates to unwind the wound continuous paper P.

The wind rolls 26 are rolls on which the continuous paper P is wound. Specifically, the continuous paper P is wound on the wind rolls 26 between the unwind roll 22 and the take-up roll 24. Thus, a feeding path of the continuous paper P from the unwind roll 22 to the take-up roll 24 is determined.

The take-up roll 24 is a roll that takes up the continuous paper P. The take-up roll 24 is rotationally driven by a driving portion 28. Thus, the take-up roll 24 takes up the continuous paper P and the unwind roll 22 unwinds the continuous paper P. When the continuous paper P is taken up by the take-up roll 24 and unwound by the unwind roll 22, the continuous paper P is fed. The wind rolls 26 are driven and rotated by the continuous paper P which is being fed.

Incidentally, in the respective drawings, the feeding direction of the continuous paper P is indicated by an arrow A if necessary. In addition, the "feeding direction of the continuous paper P" will be referred to as "feeding direction" simply in some cases. Further, the "widthwise direction of the continuous paper P" will be referred to as "widthwise direction" simply in some cases.

In addition, in the exemplary embodiment, the feeding rate of the continuous paper P is made selectable between a normal mode (for example, 50 m/min) and a low-rate mode (for example, 20 m/min). Each of the normal mode and the low-rate mode may be set in many stages.

(Ejection Unit 30)

The ejection unit 30 illustrated in FIG. 1 is an example of an ejection portion that ejects liquid droplets onto a recording medium. Specifically the ejection unit 30 is a unit that ejects ink droplets (an example of the liquid droplets) onto an image surface (one surface) of the continuous paper P which is being fed by the feed mechanism 20. More specifically, the ejection unit 30 has ejection heads 32Y, 32M, 32C and 32K (hereinafter referred to as 32Y to 32K) which eject ink droplets of respective colors, that is, yellow (Y), magenta (M), cyan (C) and black (K) respectively onto the image surface of the continuous paper P, as shown in FIG. 1.

The ejection heads 32Y to 32K are disposed in this order toward the upstream side in the feeding direction of the continuous paper P. Each of the ejection heads 32Y to 32K has length in a widthwise direction of the continuous paper P (a cross direction crossing the feeding direction of the continuous paper P, that is, the front/back direction in FIG. 1). Each ejection head 32Y to 32K ejects ink droplets in a known system such as a thermal system or a piezoelectric system. Thus, an image is formed on the continuous paper P. In the following description, a part on which ink droplets have been ejected to form an image in the continuous paper P will be referred to as "image portion". On the other hand, a part on which no ink droplets have been ejected in the continuous paper P, that is, a part where no image has been formed in the continuous paper P will be referred to as "non-image portion". In addition, in each drawing, the widthwise direction of the continuous paper P is indicated by an arrow W if necessary.

The ejection unit 30 can produce a distribution in a proper quantity of ink (image density) over an irradiation range (35 mm) of each irradiation array 44 extending in a feeding direction A. The irradiation array 44 will be described later. In addition, the ejection unit 30 can produce a distribution in a proper quantity of ink (image density) over an irradiation range (35 mm) of each irradiation array 84 extending in a widthwise direction W. The irradiation array 84 will be described later. To produce a distribution in a proper quantity of ink (image density) includes a case where an image portion and a non-image portion (with an ink quantity of 0) are mixed and a case where a distribution in a proper quantity of ink (image density) is produced in an image portion.

(First Drying Portion 50)

The first drying portion 50 illustrated in FIG. 1 is an example of a drying portion that dries a recording medium. Specifically, the first drying portion 50 is a drying unit that irradiates an image surface of the continuous paper P, where ink droplets have been ejected from the ejection unit 30, with laser light to thereby dry the continuous paper P. That is, the first drying portion 50 may be regarded as a drying unit that applies light energy to the image surface of the continuous paper P, where ink droplets have been ejected from the ejection unit 30, in a noncontact manner to thereby dry the continuous paper P. Further, to say other words, the first drying portion 50 irradiates the image surface of the continuous paper P with laser light and heats the infrared absorbent in the ink droplets due to the light energy to thereby evaporate (vaporize) the ink droplets and moisture of the continuous paper P and dry the image portion. More specifically, the first drying portion 50 is configured as follows.

As illustrated in FIG. 1, the first drying portion 50 is disposed on the downstream side in the feeding direction with respect to the ejection unit 30. Accordingly, the continuous paper P where ink droplets have been ejected to form an image by the ejection unit 30 is fed to the first drying portion 50.

Further, the first drying portion 50 has a housing 53, a first irradiation device 51 (an example of a first irradiation device) and a second irradiation device 52 (an example of a second irradiation device). A passageway 54 through which the continuous paper P is fed is formed inside the housing 53.

The passageway 54 is formed on the left side of the inside of the housing 53 in FIG. 1 so as to extend in the up/down direction. In addition, the passageway 54 has an inlet 54A and an outlet 54B. The continuous paper P is introduced into the passageway 54 through the inlet 54A and discharged through the outlet 54B. In the passageway 54, the continuous paper P is fed downward in a state where the image surface of the continuous paper P faces to the right side (toward the first irradiation device 51 and the second irradiation device 52) in FIG. 1.

The first irradiation device 51 and the second irradiation device 52 are disposed on the image surface side (on the right side in FIG. 1) with respect to the continuous paper P fed through the passageway 54 inside the housing 53. Further, the first irradiation device 51 and the second irradiation device 52 are disposed toward the upstream (upward) in the feeding direction A of the continuous paper P in this order. That is, the second irradiation device 52 is disposed on the upstream side in the feeding direction with respect to the first irradiation device 51.

Figure 4:
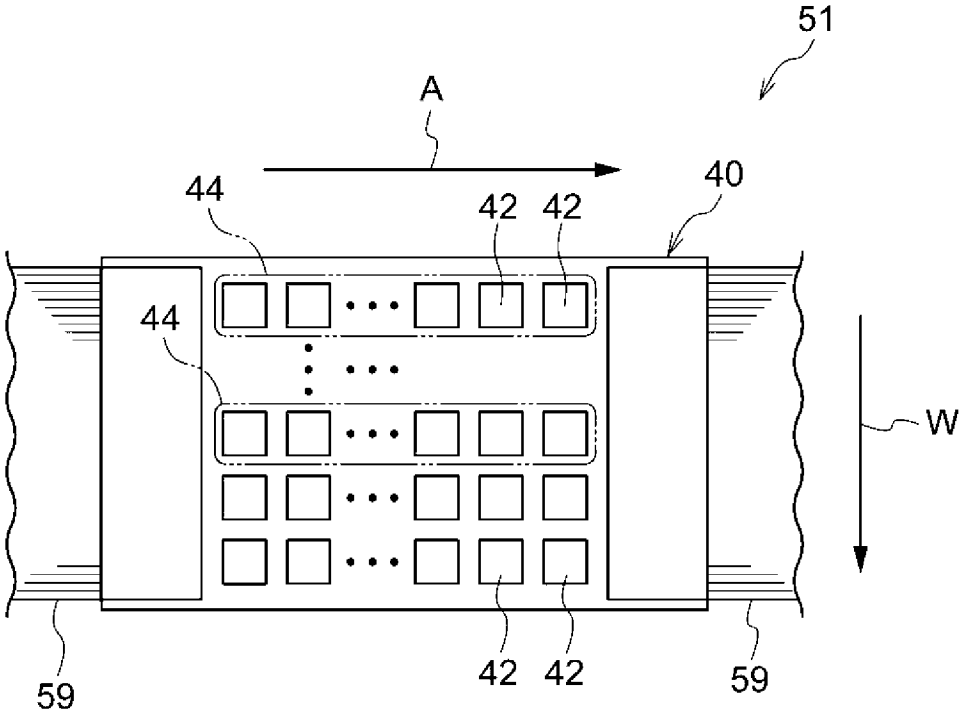
FIG. 4 is a bottom view illustrating the configuration of the irradiation unit in the first irradiation device of the first drying portion according to the exemplary embodiment.

The first irradiation device 51 is an example of the first irradiation device including plural irradiation arrays in each of which plural laser elements are disposed along the feeding direction of a recording medium to which liquid droplets have been ejected and which is being fed. The recording medium is irradiated with laser light by the laser elements. Driving the first irradiation device 51 is controlled for each irradiation array. Specifically, as illustrated in FIG. 4, the first irradiation device 51 includes plural irradiation arrays 44 (an example of the first irradiation arrays) in each of which plural laser elements 42 are disposed in the feeding direction A of the continuous paper P to which ink droplets have been ejected and which is being fed. The continuous paper P is irradiated with laser light by the laser elements 42. Driving the first irradiation device 51 is controlled for each irradiation array 44.

Figure 2:
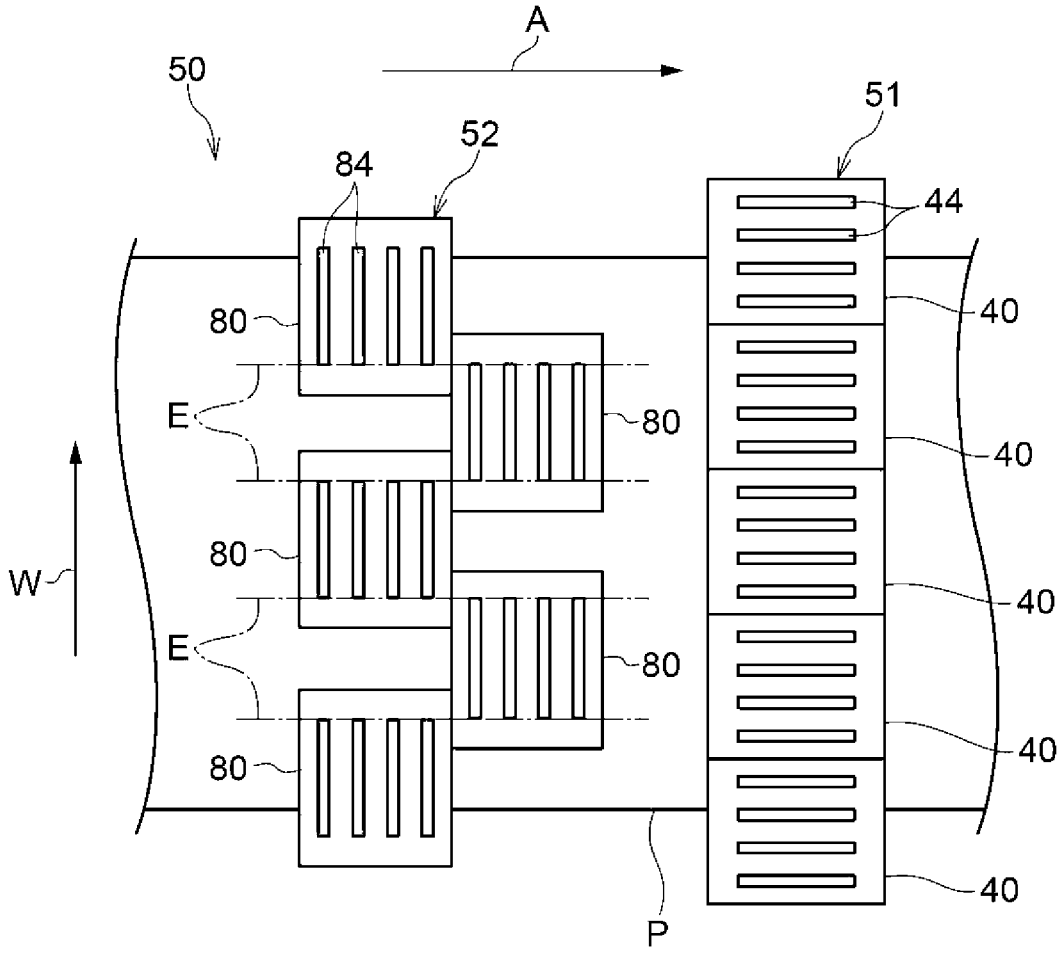
FIG. 2 is a schematic view illustrating a configuration of a first drying portion of the inkjet recording apparatus according to the exemplary embodiment.

More specifically the first irradiation device 51 is configured as follows. That is, the first irradiation device 51 has a plurality (for example, 26) of irradiation units 40 as shown in FIG. 2. The irradiation units 40 are disposed along the widthwise direction W of the continuous paper P.

Figure 3:
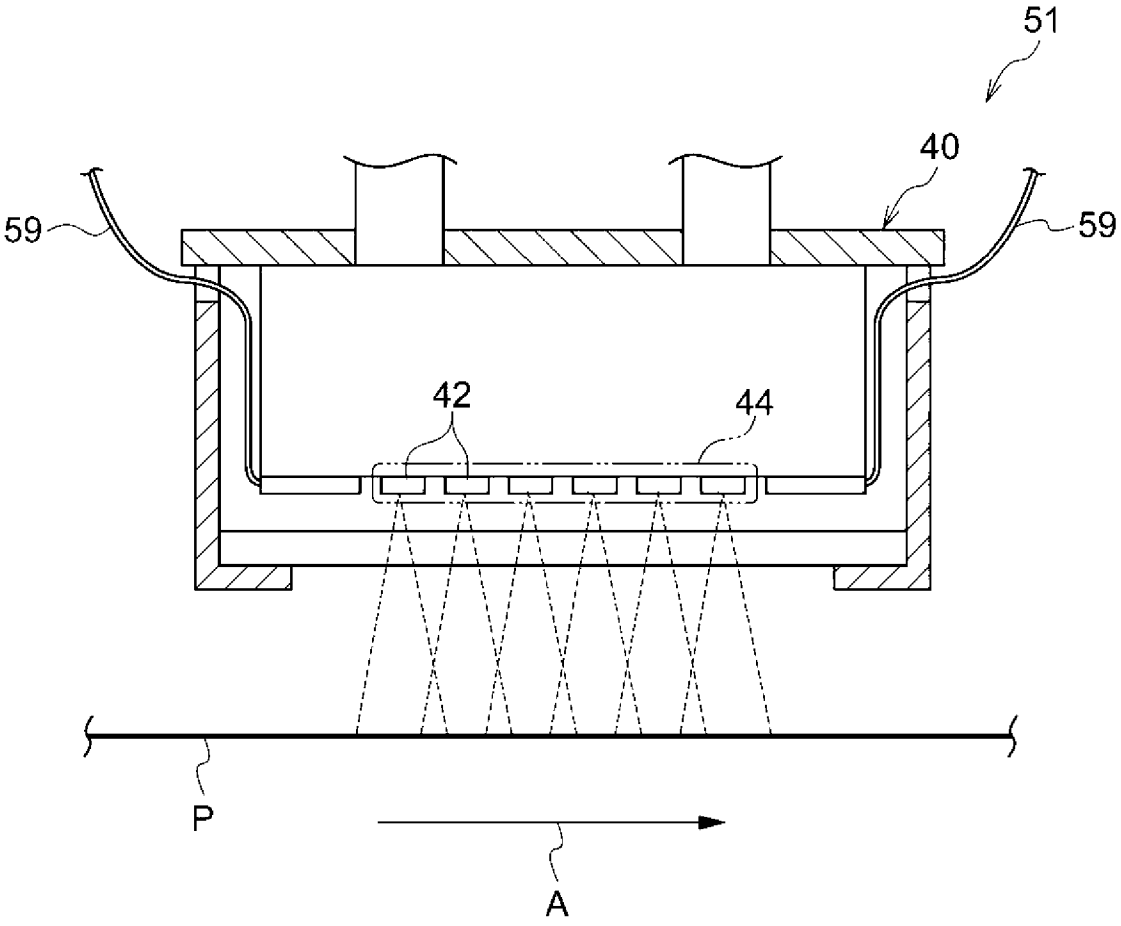
FIG. 3 is a side view illustrating a configuration of an irradiation unit in a first irradiation device of the first drying portion according to the exemplary embodiment.

Each irradiation unit 40 has, for example, 16 irradiation arrays 44 in each of which, for example, 20 laser elements 42 for irradiating the continuous paper P with laser light are disposed along the feeding direction A, as shown in FIG. 3 and FIG. 4. The irradiation arrays 44 are disposed side by side in the widthwise direction W of the continuous paper P.

For example, surface emitting laser elements that perform surface light emission are used as the laser elements 42. For example, laser elements each including a vertical resonator type light emitting element in which plural light emitting elements are disposed in a lattice to be arranged in the feeding direction A and the widthwise direction W are used as the surface light emitting laser elements. Such a laser element is also referred to as VCSEL (Vertical Cavity Surface Emitting Laser).

In each irradiation array 44, the laser elements 42 are, for example, electrically connected in series. The irradiation arrays 44 are connected to a driving portion 55 (see FIG. 1) through wirings 59 respectively. Driving the irradiation arrays 44 (such as irradiation timing and irradiation intensity) is controlled for each irradiation array 44 by the driving portion 55. In each irradiation array 44, the plural laser elements 42 are turned on or turned off in a lump. In the first irradiation device 51, the wirings 59 are extracted from the longitudinally opposite end portions of each irradiation array 44 of each irradiation unit 40 respectively (see FIG. 3 and FIG. 4).

Each irradiation array 44 has an irradiation region for the continuous paper P. In the irradiation region, an irradiation range (for example, 35 mm) in the feeding direction A is longer than an irradiation range (for example, 3 mm) in the widthwise direction W. The irradiation region is a region where the intensity of laser light on the continuous paper P has at least half the peak. The irradiation region depends on a spread angle of the laser light and a distance between each irradiation unit 40 and the paper surface of the continuous paper P. In addition, the irradiation range along the widthwise direction W corresponds to an irradiation length along the widthwise direction W on the continuous paper P in the irradiation region. On the other hand, the irradiation range in the feeding direction A corresponds to an irradiation length along the feeding direction A on the continuous paper P in the irradiation region.

In the irradiation region of each irradiation array 44 serving as a unit to be driven, the irradiation intensity is made constant within a predetermined allowable range in the feeding direction A and the widthwise direction W. To say other words, in the irradiation region of the irradiation array 44, a distribution exceeding the allowable range cannot be produced in the irradiation intensity in the feeding direction A and the widthwise direction W.

In addition, the irradiation range (for example, 3 mm) along the widthwise direction W in each irradiation array 44 is made shorter than the irradiation range (for example, 35 mm) along the widthwise direction W in each irradiation array 84 of the second irradiation device 52. The irradiation array 84 will be described later. Specifically, the irradiation range (for example, 3 mm) along the widthwise direction W in each irradiation array 44 is made not longer than ½ of the irradiation range (for example, 35 mm) along the widthwise direction W in each irradiation array 84. As a result, the first irradiation device 51 can produce a distribution in the irradiation intensity of the irradiation arrays 44 within the irradiation range (for example, 35 mm) along the widthwise direction W in each irradiation array 84 that will be described later.

In addition, in the first irradiation device 51, the irradiation arrays 44 irradiate the continuous paper P with laser light without any space in the widthwise direction W. That is, in the first irradiation device 51, the irradiation regions of the irradiation arrays 44 are disposed without any space in the widthwise direction W. Specifically, in the first irradiation device 51, the irradiation arrays 44 irradiate the continuous paper P with laser light overlapped in the widthwise direction W. That is, in the first irradiation device 51, the irradiation regions of the irradiation arrays 44 are disposed to be overlapped in the widthwise direction W.

Figure 6:
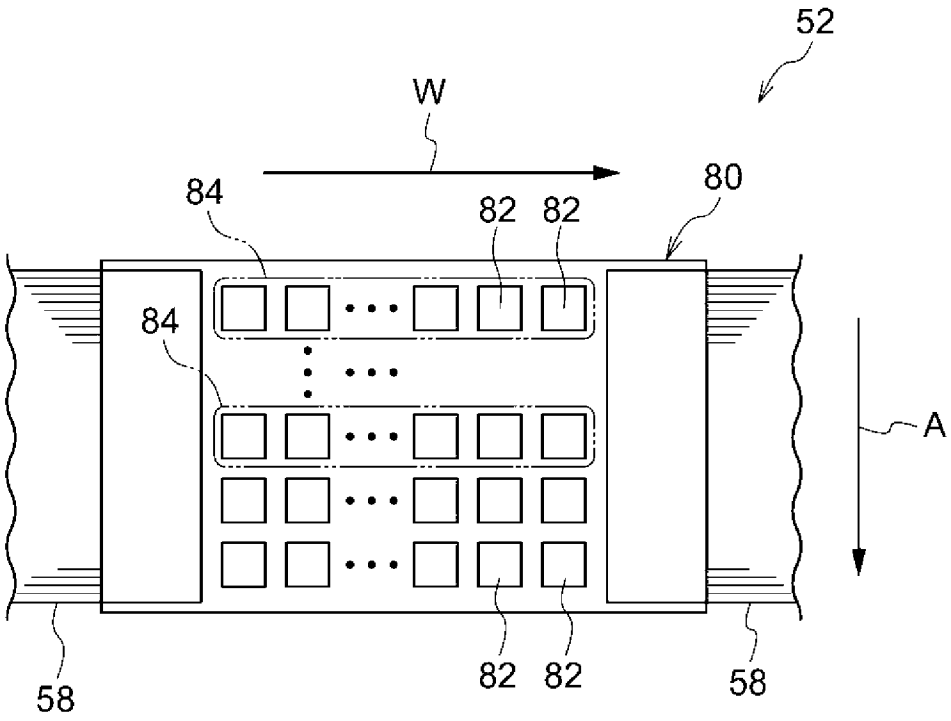
FIG. 6 is a bottom view illustrating the configuration of the irradiation unit in the second irradiation device of the first drying portion according to the exemplary embodiment.

The second irradiation device 52 is an example of the second irradiation device including plural irradiation arrays in each of which plural laser elements for irradiating the recording medium with laser light are disposed along the cross direction. The irradiation arrays are disposed side by side in the feeding direction. Driving the irradiation arrays is controlled for each irradiation array. Specifically, as illustrated in FIG. 6, the second irradiation device 52 includes plural irradiation arrays 84 (an example of the second irradiation arrays) in each of which plural laser elements 82 for irradiating the continuous paper P with laser light are disposed along the widthwise direction W. The irradiation arrays 84 are disposed side by side in the feeding direction A, and driven for each irradiation array 84.

More specifically the second irradiation device 52 is configured as follows. That is, the second irradiation device 52 has a plurality (for example, 26) of irradiation units 80 as shown in FIG. 2. The irradiation units 80 are disposed zigzag along the widthwise direction W of the continuous paper P.

Figure 5:
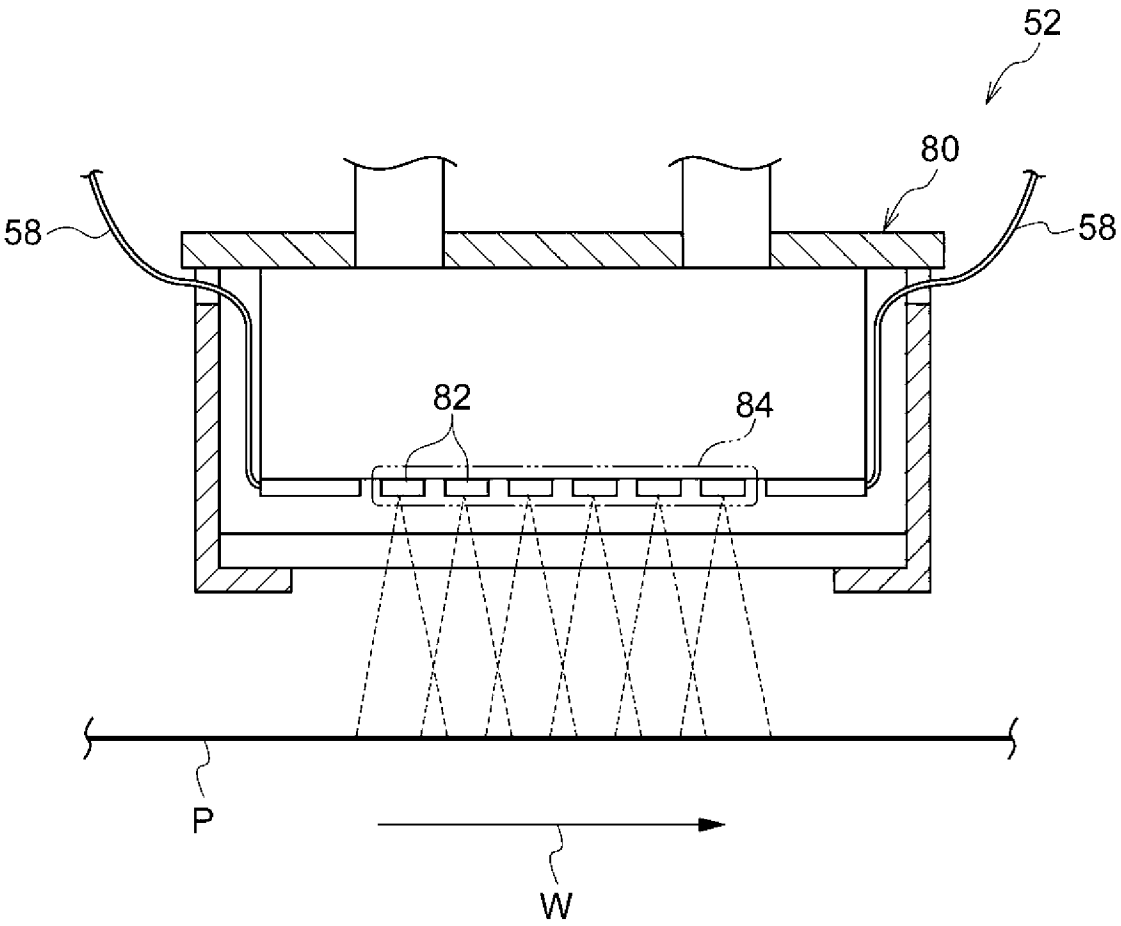
FIG. 5 is a side view illustrating a configuration of an irradiation unit in a second irradiation device of the first drying portion according to the exemplary embodiment.

Each irradiation unit 80 has, for example, 16 irradiation arrays 84 in each of which, for example, 20 laser elements 82 for irradiating the continuous paper P with laser light are disposed along the widthwise direction W, as shown in FIG. 5 and FIG. 6. The irradiation arrays 84 are disposed side by side in the feeding direction A of the continuous paper P. The irradiation units 40 turned by 90 degrees may be used as the irradiation units 80.

For example, surface emitting laser elements that perform surface light emission are used as the laser elements 82 in the same manner as the laser elements 42. For example, laser elements each including a vertical resonator type light emitting element in which plural light emitting elements are disposed in a lattice to be arranged in the feeding direction A and the widthwise direction W are used as the surface light emitting laser elements. Such a laser element is also referred to as VCSEL (Vertical Cavity Surface Emitting Laser).

In each irradiation array 84, the laser elements 82 are, for example, electrically connected in series. The irradiation arrays 84 are connected to a driving portion 56 (see FIG. 1) through wirings 58 respectively. Driving the irradiation arrays 84 (such as irradiation timing and irradiation intensity) is controlled for each irradiation array 84 by the driving portion 56. In each irradiation array 84, the laser elements 82 are turned on or turned off in a lump.

In the second irradiation device 52, the wirings 58 are extracted from the longitudinally opposite end portions of each irradiation array 84 of each irradiation unit 80 respectively (see FIG. 5 and FIG. 6). In addition, in the second irradiation device 52, the irradiation units 80 are disposed zigzag along the widthwise direction W so that adjacent ones of the irradiation units 80 in the widthwise direction W are displaced from each other in the feeding direction A. Accordingly, the irradiation units 80 are disposed along the widthwise direction W so that the wirings 58 of the irradiation units 80 are prevented from interfering with each other.

Each irradiation array 84 has an irradiation region for the continuous paper P. In the irradiation region, an irradiation range (for example, 35 mm) in the widthwise direction W is longer than an irradiation range (for example, 3 mm) in the feeding direction A. The irradiation range in the feeding direction A corresponds to an irradiation length along the feeding direction A on the continuous paper P in the irradiation region. On the other hand, the irradiation range in the widthwise direction W corresponds to an irradiation length along the widthwise direction W on the continuous paper P in the irradiation region.

In the irradiation region of each irradiation array 84 serving as a unit to be driven, the irradiation intensity is made constant within a predetermined allowable range in the feeding direction A and the widthwise direction W. To say other words, in the irradiation region of the irradiation array 84, a distribution exceeding the allowable range cannot be produced in the irradiation intensity in the feeding direction A and the widthwise direction W.

In addition, the irradiation range (for example, 3 mm) along the feeding direction A in each irradiation array 84 is made shorter than the irradiation range (for example, 35 mm) along the feeding direction A in each irradiation array 44. Specifically, the irradiation range (for example, 3 mm) along the feeding direction A in each irradiation array 84 is made not longer than ½ of the irradiation range (for example, 35 mm) along the feeding direction A in each irradiation array 44. As a result, the second irradiation device 52 can produce a distribution in the irradiation intensity of the irradiation arrays 84 within the irradiation range (for example, 35 mm) along the feeding direction A in each irradiation array 44.

In addition, as shown in FIG. 2, in the second irradiation device 52, the irradiation arrays 84 are disposed without any space in the widthwise direction W (see the alternate long and short dash line E) between adjacent ones of the irradiation units 80 in the widthwise direction W. Specifically, in the second irradiation device 52, the irradiation arrays 84 are disposed to be overlapped in the widthwise direction W. To say other words, in the second irradiation device 52, the irradiation arrays 84 irradiate the continuous paper P with laser light without any space in the widthwise direction W. Specifically, in the second irradiation device 52, the irradiation arrays 84 irradiate the continuous paper P with laser light overlapped in the widthwise direction W.

The peak wavelength of laser light in each laser element 82 of the second irradiation device 52 is a wavelength in which absorptivity in the non-image portion of the continuous paper P is 10% or less. Specifically the peak wavelength of laser light in each laser element 82 is, for example, set within a range not shorter than 650 nm and not longer than 1,100 nm. More specifically the peak wavelength of laser light in each laser element 82 is, for example, set at 815 nm.

In the first irradiation device 51 and the second irradiation device 52, the image surface of the continuous paper P is irradiated with laser light continuously from the laser elements 82 and 42 so that moisture of ink droplets and moisture of the continuous paper P are heated by light energy. Thus, the moisture is evaporated (vaporized) to dry the ink droplets and the continuous paper P.

In the illustration of FIG. 2, the first irradiation device 51 and the second irradiation device 52 are simplified. The numbers of the irradiation units 80 and 40 and the numbers of the irradiation arrays 84 and 44 in FIG. 2 are different from those in an actual configuration. In addition, although each irradiation array 84, 44 is constituted by plural laser elements 82, 42 as described previously, the irradiation array 84, 44 is illustrated integrally in FIG. 2. In addition, the irradiation units 80 and 40 illustrated in FIG. 3, FIG. 4, FIG. 5 and FIG. 6 are simplified. The number of the laser elements 82, 42 in each irradiation array 84, 44 illustrated in FIG. 3 and FIG. 5 is different from that in the actual configuration.

(Second Drying Portion 60)

The second drying portion 60 illustrated in FIG. 1 is a drying portion that comes in contact with the non-image surface (the other surface) of the recording medium in which the liquid droplets have been dried by the first drying portion, so as to heat the recording medium and dry the recording medium. Specifically the second drying portion 60 is a drying portion that comes in contact with only the non-image surface of the continuous paper P in which the ink droplets have been dried by the first drying portion 50, so as to heat the continuous paper P and dry the continuous paper P.

More specifically the second drying portion 60 has a drying drum 62. The drying drum 62 is, for example, constituted by a cylindrical drum made of metal. In the second drying portion 60, the drum surface is heated by a heat source such as a halogen lamp disposed inside the drying drum 62.

The drying drum 62 is disposed on the downstream side in the feeding direction with respect to the first drying portion 50. The continuous paper P is wound around the drying drum 62 so as to bring the non-image surface of the continuous paper P into contact with the outer circumferential surface of the drying drum 62.

In the second drying portion 60, a part of the continuous paper P in which the ink droplets have been dried by the first drying portion 50 is fed to the drying drum 62, and the non-image surface in the part is heated by the drying drum 62. Thus, the continuous paper P is dried. The surface temperature of the drying drum 62 is, for example, set within a range not lower than 70° C. and not higher than 150° C.

In this manner, in the second drying portion 60, the drying drum 62 comes in contact with only the non-image surface of the continuous paper P so as to heat the continuous paper P and dry the continuous paper P. To say other words, the second drying portion 60 does not have any contact member in contact with the image surface of the continuous paper P. To say more other words, in the second drying portion 60, the continuous paper P is not held from both the image surface and the non-image surface of the continuous surface P. Further, to say more other words, in the second drying portion 60, the non-image surface is not pressed against the drying drum 62.

(Cooling Portion 70)

The cooling portion 70 illustrated in FIG. 1 has a function of cooling the continuous paper P. Specifically the cooling portion 70 has a cooling roll 72 that comes in contact with the image surface of the continuous paper P so as to cool the continuous paper P. The cooling roll 72 is disposed on the downstream side in the feeding direction with respect to the second drying portion 60. The continuous paper P is wound around the cooling roll 72 so as to bring the image surface of the continuous paper P into contact with the outer circumferential surface of the cooling roll 72.

In the cooling portion 70, a part of the continuous paper P in which the continuous paper P has been dried by the second drying portion 60 is fed to the cooling roll 72, and the image surface in the part is cooled by the cooling roll 72.

(Operation in Exemplary Embodiment)

According to the inkjet recording apparatus 10, ink droplets are ejected from the ejection unit 30 toward the image surface of the continuous paper P fed from the unwind roll 22 toward the take-up roll 24. Thus, an image is formed in the image surface.

The image formed in the continuous paper P is fed to the first drying portion 50. In the first drying portion 50, the image surface of the continuous paper P is irradiated with laser light from the first irradiation device 51 and the second irradiation device 52. Thus, the continuous paper P (the ink droplets in the image portion and the non-image portion) is dried.

Further, the continuous paper P is fed to the second drying portion 60. In the second drying portion 60, the drying drum 62 in contact with the non-image surface of the continuous paper P heats the non-image surface. Thus, the continuous paper P is dried. Then the continuous paper P is cooled by the cooling portion 70. After that, the continuous paper P is taken up by the take-up roll 24.

As described previously, in the first drying portion 50, the continuous paper P is irradiated with laser light from the second irradiation device 52 in which the irradiation arrays 84 each having plural laser elements 82 disposed along the widthwise direction W are disposed in the feeding direction A and the first irradiation device 51 in which the irradiation arrays 44 each having plural laser elements 42 disposed along the feeding direction A are disposed in the widthwise direction W. Thus, the continuous paper P is dried.

(Comparison Between Operation of Exemplary Embodiment and Operation of First Comparative Example)

Figure 7:
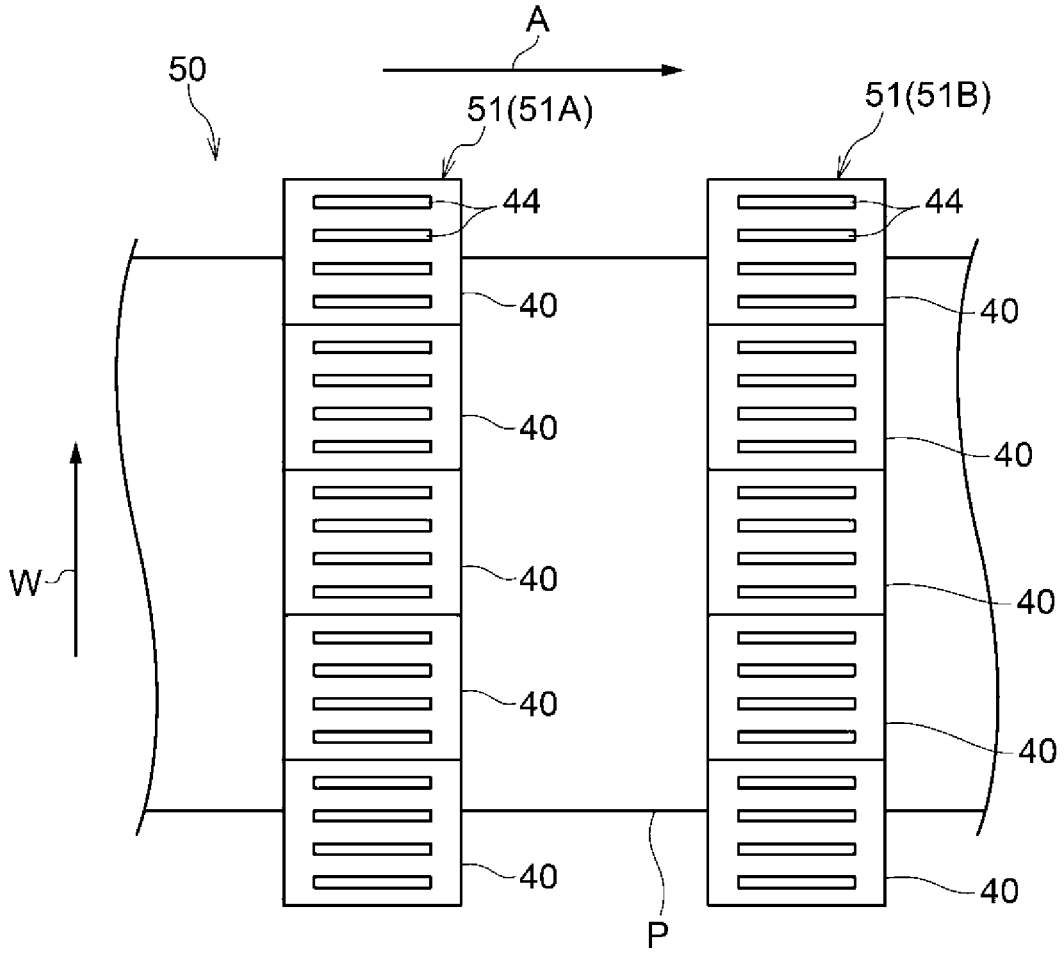
FIG. 7 is a schematic view illustrating a configuration of a first drying portion according to a first comparative example.

Here, as illustrated in FIG. 7, in a configuration (first comparative example) where the first drying portion 50 has another first irradiation device 51 in place of the second irradiation device 52, wrinkles may be generated in the continuous paper P as follows.

To say other words, the configuration of the first comparative example is a configuration in which the first drying portion 50 has two first irradiation devices 51, that is, a configuration in which the first drying portion 50 has only the first irradiation devices 51. In the following description, of the two first irradiation devices 51, the first irradiation device 51 on the upstream side in the feeding direction will be referred to as first irradiation device 51A, and the first irradiation device 51 on the downstream side in the feeding direction will be referred to as first irradiation device 51B.

In the irradiation region of each irradiation array 44 serving as a unit to be driven, the irradiation intensity to the continuous paper P is fixed. Therefore, a distribution cannot be produced in the irradiation energy to the continuous paper P within the irradiation range (35 mm) of each irradiation array 44 along the feeding direction A in each first irradiation device 51A, 51B (see the solid line 51A and the broken line 51B in FIG. 8).

Figure 8:
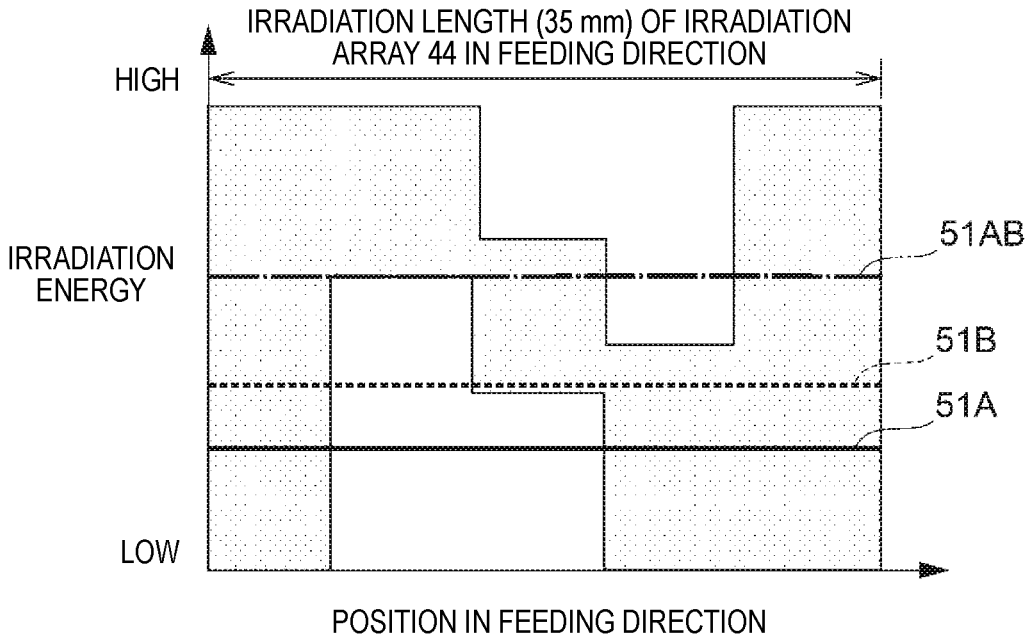
FIG. 8 is a graph showing a relation between irradiation energy of the first drying portion and an optimum range of irradiation energy to continuous paper according to the first comparative example.

In FIG. 8, the irradiation energy of the first irradiation device 51A is indicated by the solid line 51A, the irradiation energy of the first irradiation device 51B is indicated by the broken line 51B, and cumulative irradiation energy in which the irradiation energies of the first irradiation devices 51A and 51B are accumulated is indicated by the alternate long and short dash line 51AB.

In addition, the dotted part in FIG. 8 designates an example of the optimum range of the irradiation energy to the continuous paper P, in which no wrinkles occur in the continuous paper P. Since the quantity of ink adhering to the continuous paper P has a distribution in the irradiation range (35 mm) of each irradiation array 44 along the feeding direction A, the optimum irradiation energy within the optimum range varies in accordance with the position in the feeding direction A. The case where the quantity of ink adhering to the continuous paper P has a distribution includes a case where an image portion and a non-image portion (with an ink quantity of 0) are mixed and a case where the quantity of ink (density) in the image portion has a distribution.

As illustrated in FIG. 8, the cumulative irradiation energy (the alternate long and short dash line 51AB) of the first irradiation devices 51A and 51B is fixed within the irradiation range (35 mm) of each irradiation array 44 along the feeding direction A. Accordingly, the cumulative irradiation energy may be out of the optimum range in FIG. 8, to generate wrinkles in the continuous paper P.

On the other hand, according to the exemplary embodiment, laser light is radiated from the second irradiation device 52 in which the irradiation arrays 84 each having plural laser elements 82 disposed along the widthwise direction W are disposed in the feeding direction A and the first irradiation device 51 in which the irradiation arrays 44 each having plural laser elements 42 disposed along the feeding direction A are disposed in the widthwise direction W (see FIG. 2).

As a result, the irradiation range (3 mm) of each irradiation array 84 along the feeding direction A in the second irradiation device 52 is shorter than the irradiation range (35 mm) of each irradiation array 44 along the feeding direction A in the first irradiation device 51. Thus, in the second irradiation device 52, a distribution can be produced in the irradiation energy to the continuous paper P within the irradiation range (35 mm) of each irradiation array 44 along the feeding direction A (the solid line 52 in FIG. 9).

In this manner, in the first irradiation device 51, even if a distribution cannot be produced in the irradiation energy to the continuous paper P within the irradiation range (35 mm) of each irradiation array 44 along the feeding direction A in the first irradiation device 51 (the broken line 51 in FIG. 9), a distribution can be produced in the irradiation energy to the continuous paper P within the irradiation range (35 mm) of each irradiation array 44 along the feeding direction A as the cumulative irradiation energy (the alternate long and short dash line 512 in FIG. 9) of the first irradiation device 51 and the second irradiation device 52.

Figure 9:
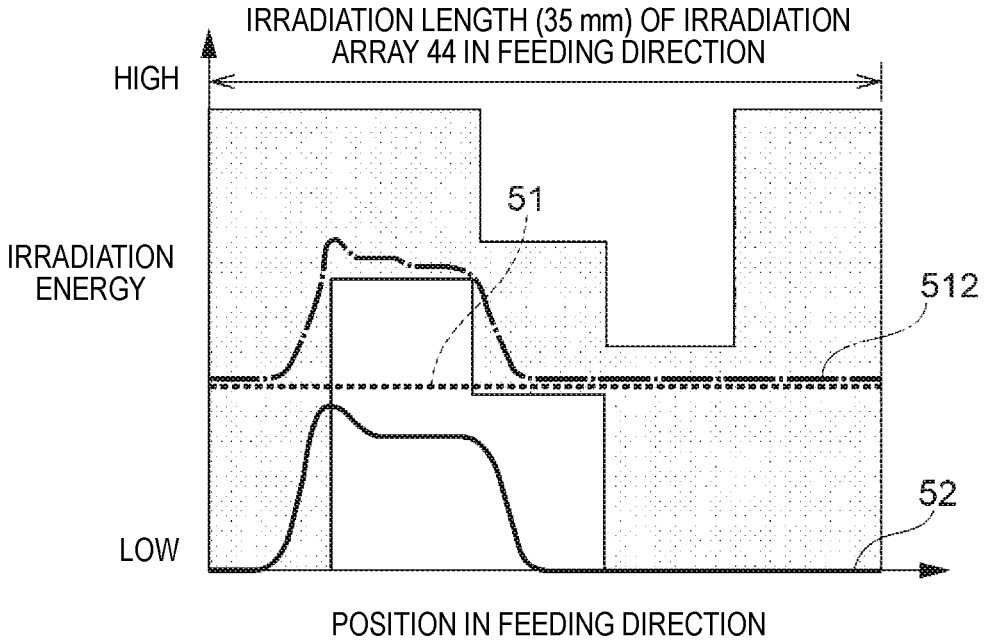
FIG. 9 is a graph showing a relation between irradiation energy of the first drying portion and an optimum range of irradiation energy to continuous paper according to the exemplary example.

Accordingly, as illustrated in FIG. 9, the cumulative irradiation energy of the first irradiation device 51 and the second irradiation device 52 is put within the optimum range in FIG. 9, so that occurrence of wrinkles in the continuous paper P is suppressed.

In FIG. 9, the irradiation energy of the second irradiation device 52 is indicated by the solid line 52, the irradiation energy of the first irradiation device 51 is indicated by the broken line 51, and the cumulative irradiation energy in which the irradiation energies of the first irradiation device 51 and the second irradiation device 52 are accumulated is indicated by the alternate long and short dash line 512.

In addition, the dotted part in FIG. 9 designates an example of the optimum range (the same optimum range as in FIG. 8) of the irradiation energy to the continuous paper P, in which no wrinkles occur in the continuous paper P. Since the quantity of ink adhering to the continuous paper P has a distribution in the irradiation range (35 mm) of each irradiation array 44 in the feeding direction A, the optimum irradiation energy within the optimum range varies in accordance with the position in the feeding direction. The case where the quantity of ink adhering to the continuous paper P has a distribution includes a case where an image portion and a non-image portion are mixed and a case where the quantity of ink (density) in the image portion has a distribution.

Figure 10:
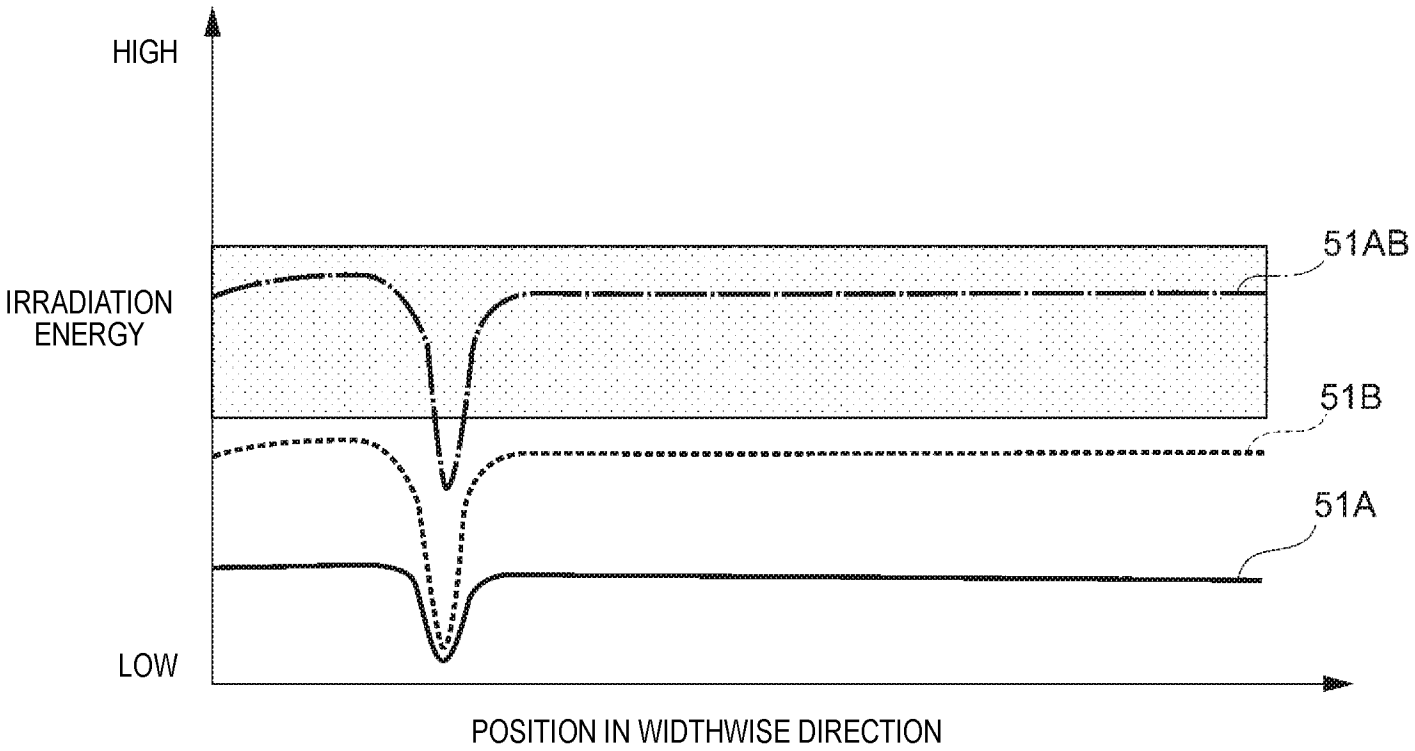
FIG. 10 is a graph showing a relation between irradiation energy in a case where a part of irradiation arrays is turned off due to deterioration or the like in the first drying portion and an optimum range of irradiation energy to continuous paper according to the first comparative example.

In addition, in the first comparative example, when parts of the irradiation arrays 44 disposed in one and the same position in the widthwise direction W are turned off in the first irradiation device 51A and the first irradiation device 51B due to deterioration, fault or the like, the irradiation energy of each first irradiation device 51A, 51B is reduced in the same position (see the solid line 51A and the broken line 51B in FIG. 10).

Therefore, as shown in FIG. 10, the cumulative irradiation energy (the alternate long and short dash line 51AB) of the first irradiation devices 51A and 51B may be out of the optimum range (dotted part) in FIG. 10 to generate wrinkles in the continuous paper P.

Figure 11:
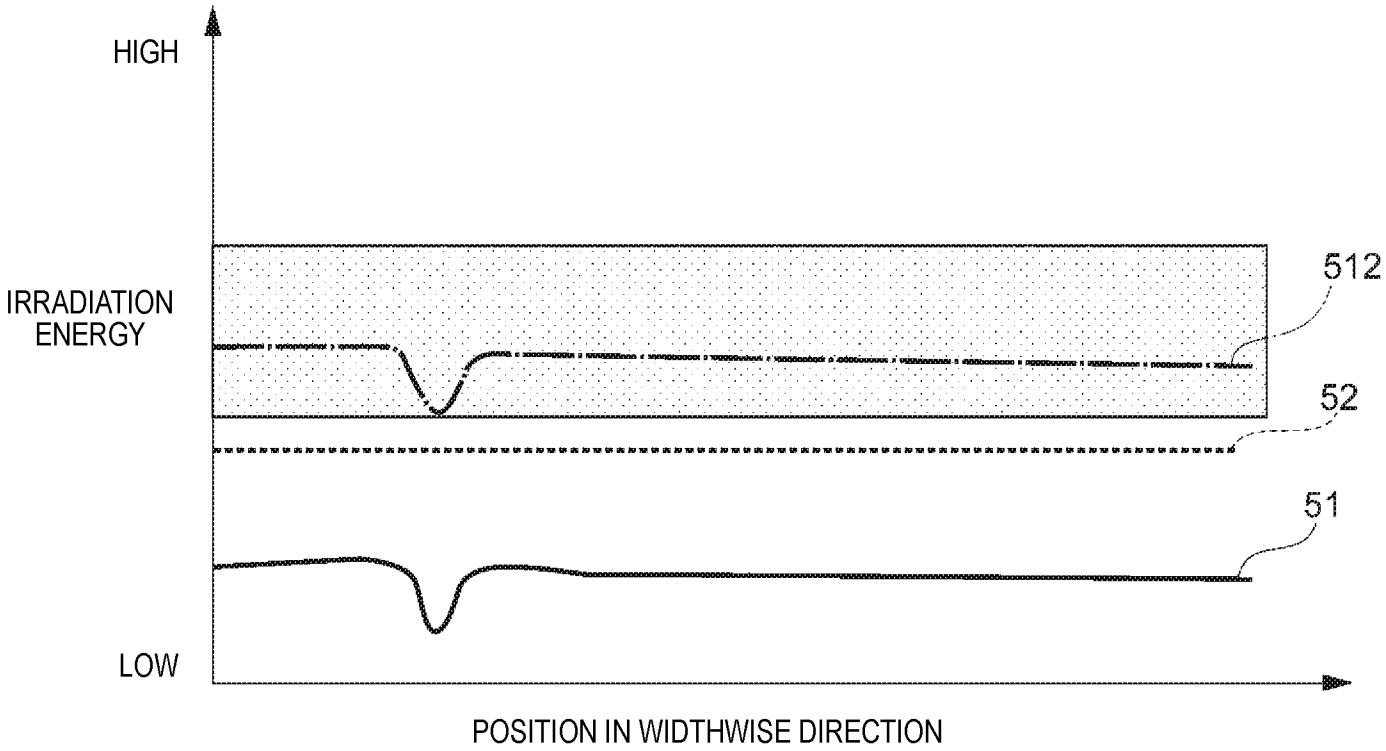
FIG. 11 is a graph showing a relation between irradiation energy in a case where a part of irradiation arrays is turned off due to deterioration or the like in the first drying portion and an optimum range of irradiation energy to continuous paper according to the exemplary embodiment.

On the other hand, according to the exemplary embodiment, a part of the irradiation arrays 44 in the first irradiation device 51 is turned off to reduce the irradiation energy due to deterioration, fault or the like (see the solid line 51 in FIG. 11), the reduced irradiation energy can be complemented by the irradiation arrays 84 of the second irradiation device (see the broken line 52 in FIG. 11). Therefore, the cumulative irradiation energy (the alternate long and short dash line 512 in FIG. 11) of the first irradiation device 51 and the second irradiation device 52 may be put within the optimum range (dotted part) in FIG. 11 to suppress the occurrence of wrinkles in the continuous paper P.

(Comparison Between Operation of Exemplary Embodiment and Operation of Second Comparative Example)

Figure 12:
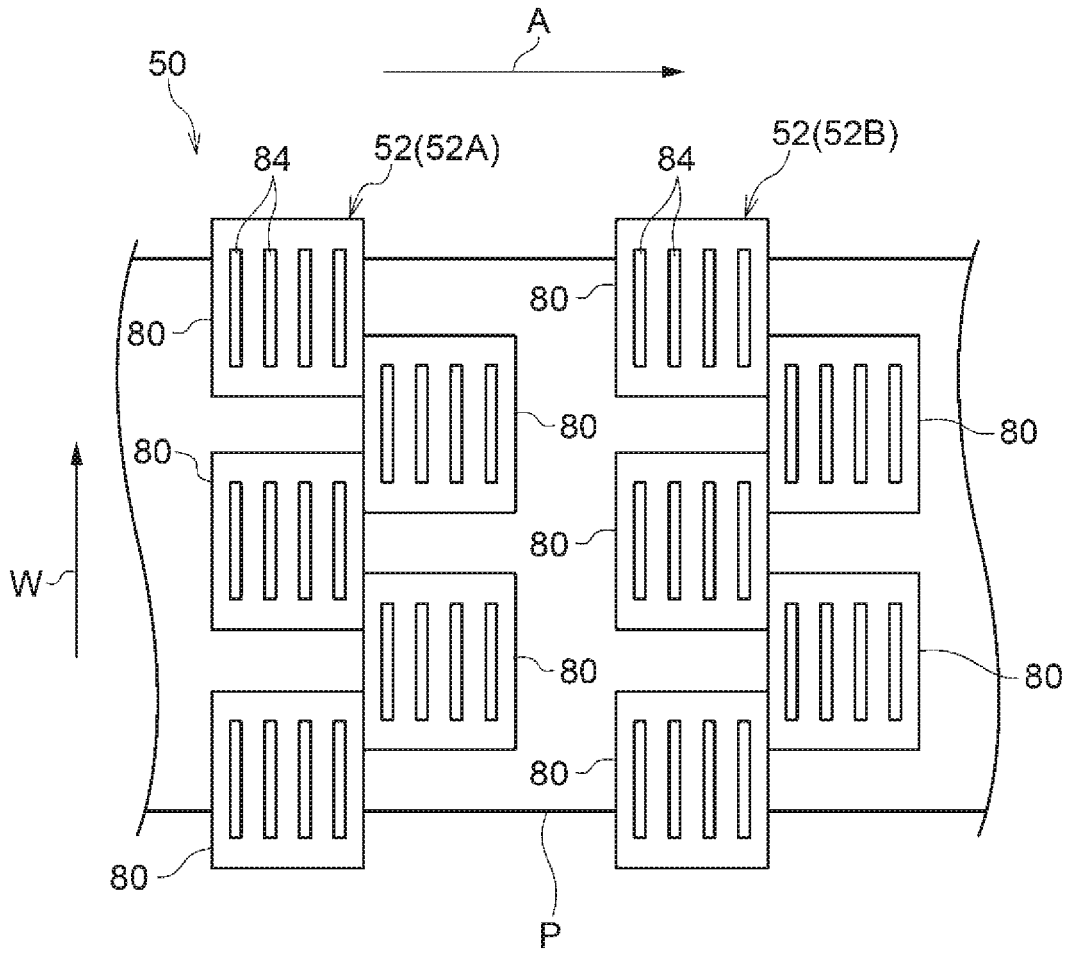
FIG. 12 is a schematic view illustrating a configuration of a first drying portion according to a second comparative example.

As illustrated in FIG. 12, in a configuration (second comparative example) where the first drying portion 50 has another second irradiation device 52 in place of the first irradiation device 51, wrinkles may be generated in the continuous paper P as follows.

To say other words, the configuration of the second comparative example is a configuration in which the first drying portion 50 has two second irradiation devices 52, that is, a configuration in which the first drying portion 50 has only the second irradiation devices 52. In the following description, of the two second irradiation devices 52, the second irradiation device 52 on the upstream side in the feeding direction will be referred to as second irradiation device 52A, and the second irradiation device 52 on the downstream side in the feeding direction will be referred to as second irradiation device 52B.

In the irradiation region of each irradiation array 84 serving as a unit to be driven, the irradiation intensity to the continuous paper P is fixed. Therefore, a distribution cannot be produced in the irradiation energy to the continuous paper P within the irradiation range (35 mm) of each irradiation array 84 along the widthwise direction W in each second irradiation device 52A, 52B (see the solid line 52A and the broken line 52B in FIG. 13).

Figure 13:
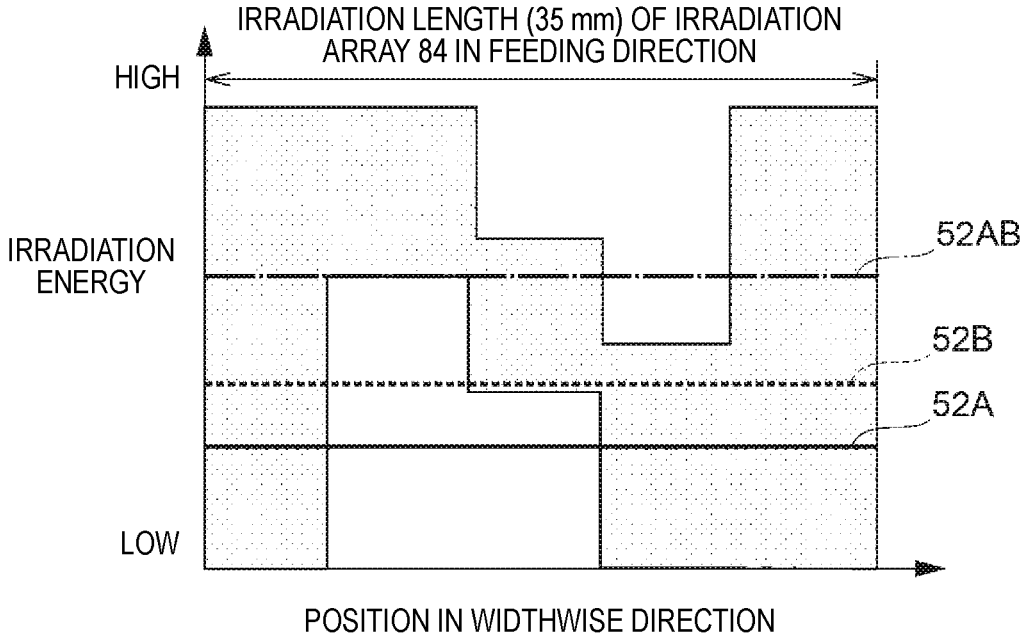
FIG. 13 is a graph showing a relation between irradiation energy of the first drying portion and an optimum range of irradiation energy to continuous paper according to the second comparative example.

In FIG. 13, the irradiation energy of the second irradiation device 52A is indicated by the solid line 52A, the irradiation energy of the second irradiation device 52B is indicated by the broken line 52B, and cumulative irradiation energy in which the irradiation energies of the second irradiation devices 52A and 52B are accumulated is indicated by the alternate long and short dash line 52AB.

In addition, the dotted part in FIG. 13 designates an example of the optimum range of the irradiation energy to the continuous paper P, in which no wrinkles occur in the continuous paper P. Since the quantity of ink adhering to the continuous paper P has a distribution in the irradiation range (35 mm) of each irradiation array 84 in the widthwise direction W, the optimum irradiation energy within the optimum range varies in accordance with the position in the widthwise direction W. The case where the quantity of ink adhering to the continuous paper P has a distribution includes a case where an image portion and a non-image portion (with an ink quantity of 0) are mixed and a case where the quantity of ink (density) in the image portion has a distribution.

As illustrated in FIG. 13, the cumulative irradiation energy (the alternate long and short dash line 52AB) of the second irradiation devices 52A and 52B is fixed within the irradiation range (35 mm) of each irradiation array 84 along the widthwise direction W. Accordingly, the cumulative irradiation energy may be out of the optimum range in FIG. 13, to generate wrinkles in the continuous paper P.

On the other hand, according to the exemplary embodiment, the irradiation range (3 mm) of each irradiation array 44 along the widthwise direction W in the first irradiation device 51 is shorter than the irradiation range (35 mm) of each irradiation array 84 along the widthwise direction W in the second irradiation device 52 (see FIG. 2). Thus, in the first irradiation device 51, a distribution can be produced in the irradiation energy to the continuous paper P within the irradiation range (35 mm) of each irradiation array 84 along the widthwise direction W (the broken line 51 in FIG. 14).

In this manner, in the second irradiation device 52, even if a distribution cannot be produced in the irradiation energy to the continuous paper P within the irradiation range (35 mm) of each irradiation array 84 along the widthwise direction W in the second irradiation device 52 (the solid line 52 in FIG. 14), a distribution can be produced in the irradiation energy to the continuous paper P within the irradiation range (35 mm) of each irradiation array 84 along the widthwise direction W as the cumulative irradiation energy (the alternate long and short dash line 512 in FIG. 14) of the first irradiation device 51 and the second irradiation device 52.

Figure 14:
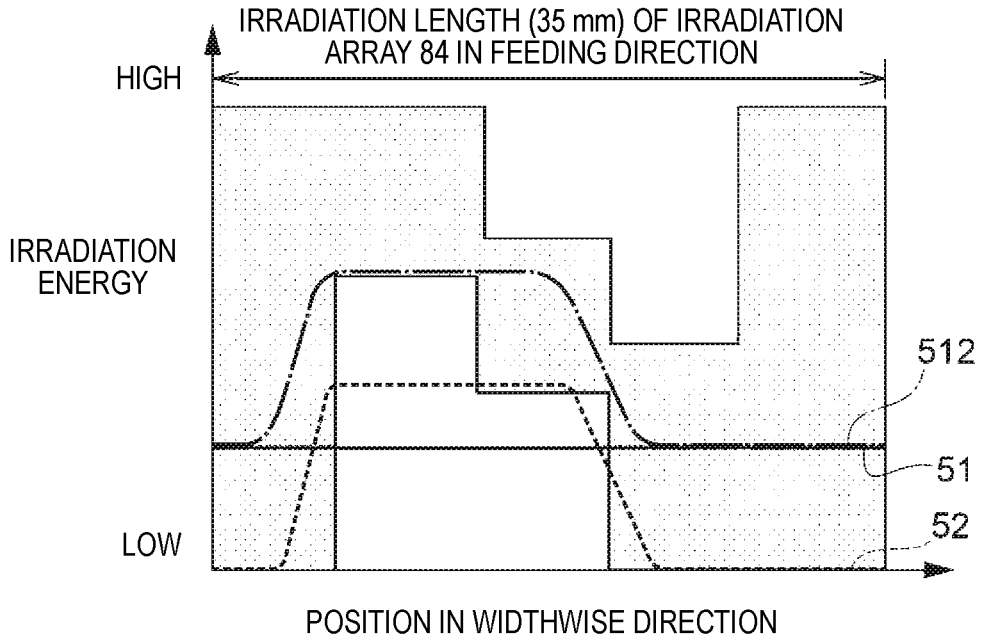
FIG. 14 is a graph showing a relation between irradiation energy of the first drying portion and an optimum range of irradiation energy to continuous paper according to the exemplary example.

Accordingly, as illustrated in FIG. 14, the cumulative irradiation energy of the first irradiation device 51 and the second irradiation device 52 is put within the optimum range in FIG. 14, so that occurrence of wrinkles in the continuous paper P is suppressed.

In FIG. 14, the irradiation energy of the second irradiation device 52 is indicated by the solid line 52, the irradiation energy of the first irradiation device 51 is indicated by the broken line 51, and the cumulative irradiation energy in which the irradiation energies of the first irradiation device 51 and the second irradiation device 52 are accumulated is indicated by the alternate long and short dash line 512.

In addition, the dotted part in FIG. 14 designates an example of the optimum range (the same optimum range as in FIG. 13) of the irradiation energy to the continuous paper P, in which no wrinkles occur in the continuous paper P. Since the quantity of ink adhering to the continuous paper P has a distribution in the irradiation range (35 mm) of each irradiation array 84 in the widthwise direction W, the optimum irradiation energy within the optimum range varies in accordance with the position in the feeding direction. The case where the quantity of ink adhering to the continuous paper P has a distribution includes a case where an image portion and a non-image portion are mixed and a case where the quantity of ink (density) in the image portion has a distribution.

(Control of Driving of Second Irradiation Device 52)

Here, specific control of driving of the second irradiation device 52 will be described.

Driving the second irradiation device 52 is controlled in accordance with the feeding rate of the continuous paper P. Specifically, when a low-rate mode is selected as the feeding rate of the continuous paper P, driving the second irradiation device 52 is controlled by the driving portion 55 as follows.

When the low-rate mode is selected, the number of driven ones of the irradiation arrays 84 in each irradiation unit 80 of the second irradiation device 52 is reduced. That is, in the low-rate mode lower in feeding rate than the normal mode, the number of driven ones of the irradiation arrays 84 to be turned on is reduced. Specifically, of the irradiation arrays 84 in each irradiation unit 80, the irradiation arrays 84 on the downstream side in the feeding direction are turned off, and the irradiation arrays 84 on the upstream side in the feeding direction are turned on. Thus, the number of driven ones of the irradiation arrays 84 is reduced.

In addition, when the low-rate mode is selected, the irradiation intensity of the irradiation arrays 84 to be turned on in each irradiation unit 80 is reduced. Of the irradiation arrays 84 to be turned on, the irradiation intensity of each irradiation array 84 on the downstream side in the feeding direction is reduced. As a result, of the irradiation arrays 84, the irradiation intensity of each irradiation array 84 on the upstream side in the feeding direction is made not lower than the irradiation intensity of each irradiation array 84 on the downstream side in the feeding direction. More specifically, of the irradiation arrays 84, the irradiation intensity of the most upstream irradiation array 84 in the feeding direction is made highest.

Further, driving the second irradiation device 52 is controlled in accordance with the kind of the continuous paper P. Specifically, the number of driven ones of the irradiation arrays 84 and the irradiation intensity of each irradiation array 84 in the second irradiation device 52 are set so that the cumulative energy of laser light with which the continuous paper P is irradiated from the second irradiation device 52 is not higher than upper limit energy, which is set in advance for each kind of continuous paper P. Specifically the upper limit energy is, for example, set in advance for each weight of the continuous paper P (an example of each kind of continuous paper P).

Figure 15:
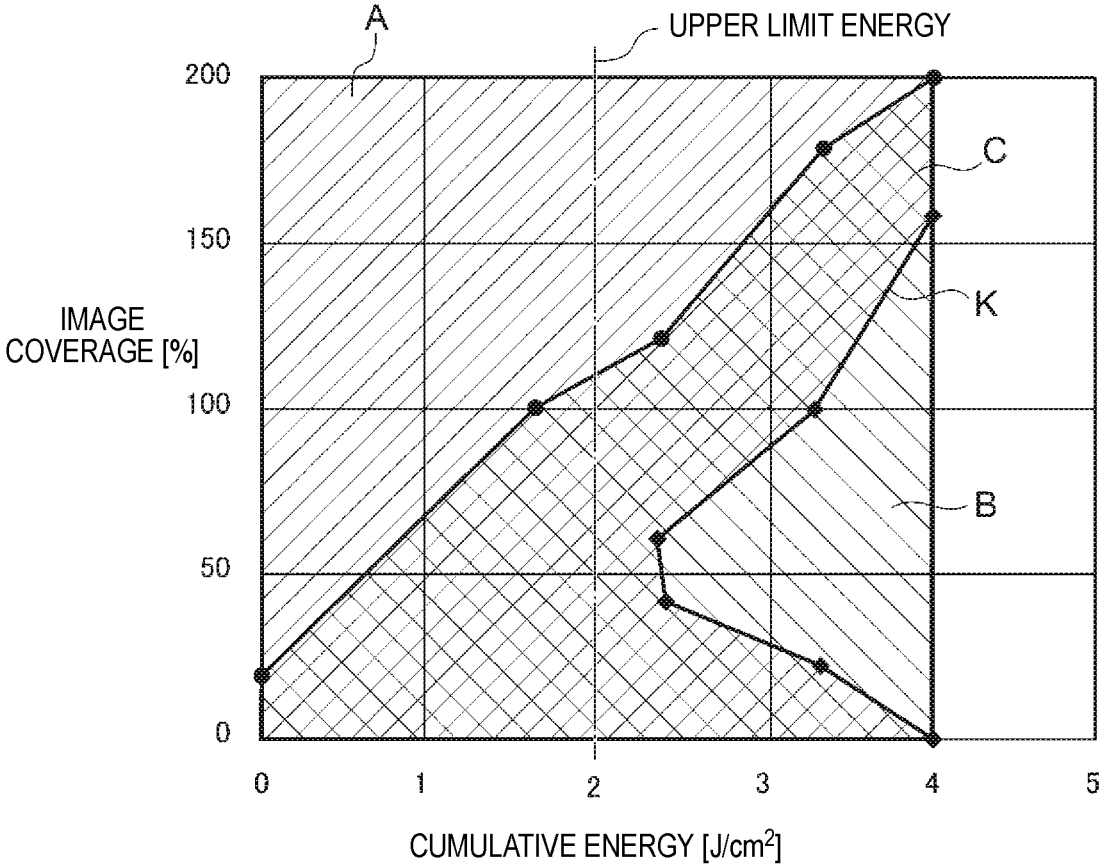
FIG. 15 is a graph showing cumulative energy for each image coverage (image density) with which no wrinkle is generated in an image portion and a non-image portion when an image pattern having the image the image portion and the non-image portion mixed therein is formed on paper having a weight of 73.3 gsm.
Figure 16:
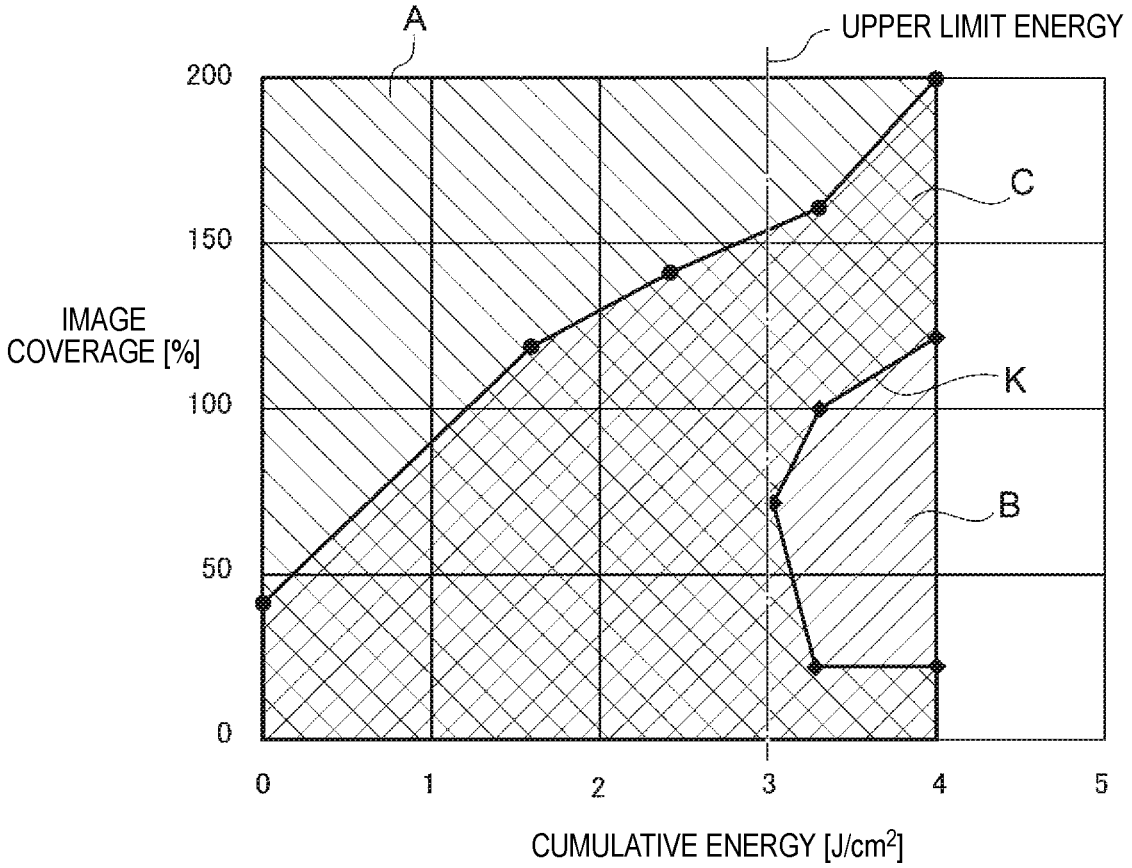
FIG. 16 is A graph showing cumulative energy for each image coverage (image density) with which no wrinkle is generated in an image portion and a non-image portion when an image pattern having the image the image portion and the non-image portion mixed therein is formed on paper having a weight of 84.9 gsm.

FIG. 15 and FIG. 16 show cumulative energy for each image coverage (image density) with which no wrinkle is generated in an image portion and a non-image portion when the image the image portion and the non-image portion are mixed in an image pattern. FIG. 15 shows cumulative energy when paper having a weight of 73.3 gsm is used as an example of the kind of continuous paper P. FIG. 16 shows cumulative energy when paper having a weight of 84.9 gsm is used as an example of the kind of continuous paper P. An image coverage of 100% in FIG. 15 and FIG. 16 corresponds to a case where a solid image has been formed, and an image coverage of 200% corresponds to a case where solid images have been superimposed.

A hatched part A with left-up lines in each of FIG. 15 and FIG. 16 designates cumulative energy in which no wrinkles occur in the non-image portion of the continuous paper P when the non-image portion is irradiated with laser light. A hatched part B with right-up lines designates cumulative energy in which no wrinkles occur in the image portion of the continuous paper P when the image portion is irradiated with laser light. The cumulative energy in the image portion is higher than the cumulative energy in the non-image portion. In addition, there is an overlapped part C where a part of the hatched part A and a part of the hatched part B are overlapped. That is, there is a cumulative energy in which no wrinkles occur in either the non-image portion or the image portion.

As illustrated in FIG. 15, when paper having a weight of 73.3 gsm is used as the kind of continuous paper P, a value (for example, 2 J/cm$^2$) lower than the upper limit (thick line K) of the cumulative energy in which no wrinkles occur in the non-image portion is set as upper limit energy. The number of driven ones of the irradiation arrays 84 and the irradiation intensity of each irradiation array 84 in the second irradiation device 52 are set so that the cumulative energy of laser light with which the continuous paper P is irradiated from the second irradiation device 52 is not higher than 2 J/cm$^2$.

On the other hand, as illustrated in FIG. 16, when paper having a weight of 84.9 gsm is used as the kind of continuous paper P, a value (for example, 3 J/cm$^2$) lower than the upper limit (thick line K) of the cumulative energy in which no wrinkles occur in the non-image portion is set as upper limit energy. The number of driven ones of the irradiation arrays 84 and the irradiation intensity of each irradiation array 84 in the second irradiation device 52 are set so that the cumulative energy of laser light with which the continuous paper P is irradiated from the second irradiation device 52 is not higher than 3 J/cm$^2$.

In addition, in the second irradiation device 52, the number of driven ones of the irradiation arrays 84 and the irradiation intensity of each irradiation array 84 are set independently of the existence/absence of the image portion, the image pattern in the continuous paper P, and the image coverage (image density) of the image portion. That is, in the second irradiation device 52, the number of driven ones of the irradiation arrays 84 and the irradiation intensity of each irradiation array 84 are set independently of the image in the continuous paper P.

When the cumulative energy of the laser light with which the continuous paper P is irradiated from the second irradiation device 52 does not reach the energy (overlapped part C) where no wrinkles occur in either the non-image portion or the image portion, the shortage is complemented by the cumulative energy of laser light with which the continuous paper P is irradiated from the first irradiation device 51.

(Control of Driving of First Irradiation Device 51)

Here, specific control of driving of the first irradiation device 51 will be described.

In the first irradiation device 51, irradiation intensity of each irradiation array 44 is controlled in accordance with a distribution in the image density of the continuous paper P in the widthwise direction W. Specifically, the irradiation intensity of each irradiation array 44 by which a part having high image density in the widthwise direction W of the continuous paper P is irradiated with laser light is increased, while the irradiation intensity of each irradiation array 44 by which a part having low image density is irradiated with laser light is reduced.

In addition, the irradiation intensity of each irradiation array 44 in the first irradiation device 51 is changed in accordance with a change of density in an image passing through the irradiation region of the irradiation array 44. That is, the irradiation intensity of each irradiation array 44 is increased when the density of the image passing through the irradiation region of the irradiation array 44 is changed to be high, and the irradiation intensity of the irradiation array 44 is decreased when the density of the image passing through the irradiation region of the irradiation array 44 is changed to be low.

(Operations of Second Irradiation Device 52 and First Irradiation Device 51)

Here, the operations of the second irradiation device and the first irradiation device 51 according to the exemplary embodiment will be described in comparison with those in each comparative example.

In the first comparative example shown in FIG. 7, when the low-rate mode is selected as the feeding rate of the continuous paper P, the irradiation time of laser light from the first irradiation device 51A on the upstream in the feeding direction toward the continuous paper P becomes long because the feeding rate of the continuous paper P is reduced. Therefore, it is necessary to reduce the irradiation intensity (irradiation energy per unit time) of each irradiation array 44 in the first irradiation device 51A so as to adjust the cumulative energy of laser light to the continuous paper P.

In this manner, in the first comparative example, it is necessary to increase the irradiation time in the low-rate mode in the state where the irradiation intensity of the first irradiation device 51A is reduced. Thus, the time to increase the ink temperature to a target temperature in the image portion of the continuous paper P is increased (see FIG. 17). As a result, the ink in the image portion is apt to permeate the inside of the continuous paper P. When the ink in the image portion permeates the inside of the continuous paper P, the coloring agent in the ink permeates the inside of the continuous paper P. Thus, the image density decreases.

Figure 17:
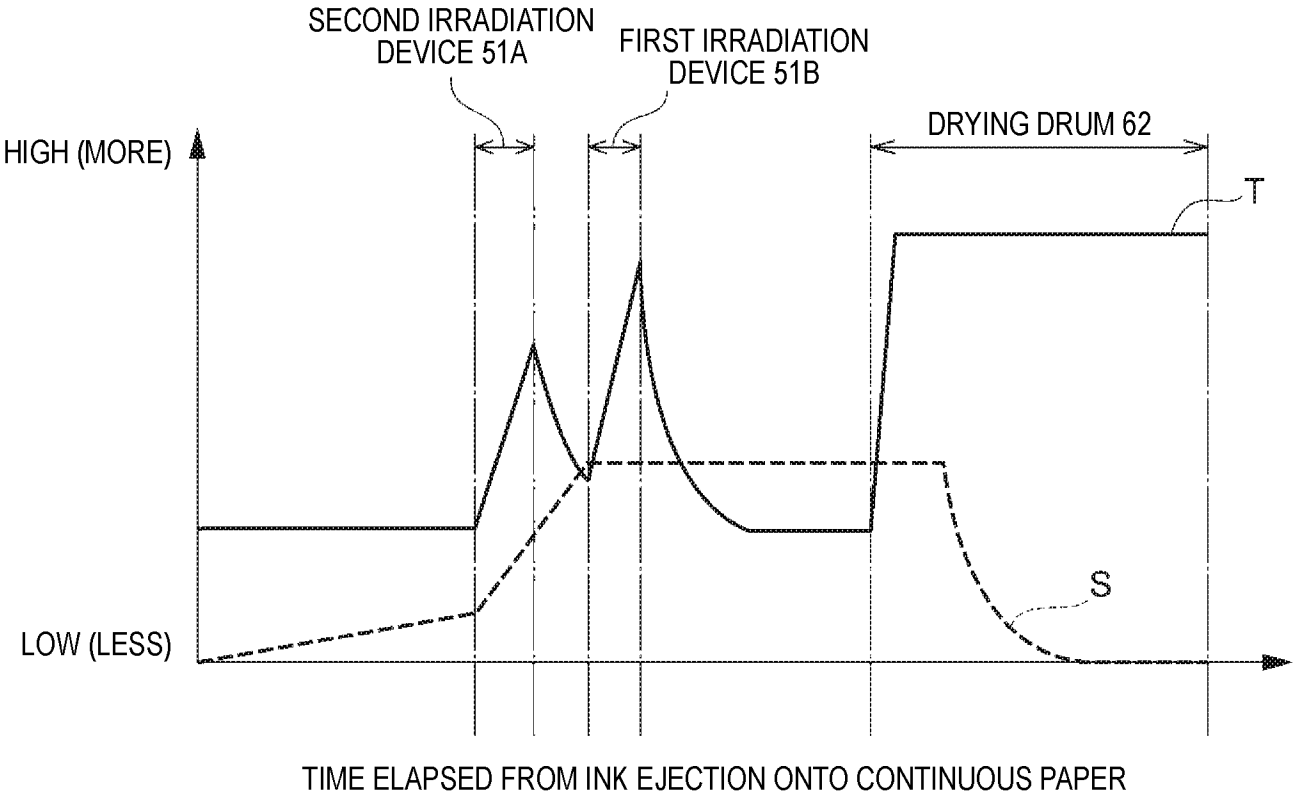
FIG. 17 is a graph showing a change of ink temperature in an image portion of continuous paper P in a case where the first drying portion according to the first comparative example is used.

In FIG. 17, the solid line T designates the ink temperature in the image portion of the continuous paper P, and the broken line S designates the quantity of ink permeating the continuous paper P. As illustrated in FIG. 17, the ink temperature in the continuous paper P increases in the first irradiation devices 51A and 51B and the drying drum 62, while the time to increase the ink temperature to the target temperature in the first irradiation device 51A is substantially equal to the time to increase the ink temperature to the target temperature in the first irradiation device 51B.

Also in a configuration in which the first irradiation device 51 and the second irradiation device 52 are replaced by each other in the first drying portion 50, that is, in a configuration (third comparative example) in which the first irradiation device 51 is disposed on the upstream side in the feeding direction with respect to the second irradiation device 52, the time to increase the ink temperature to the target temperature in the image portion of the continuous paper P in the same manner as in the first comparative example. Therefore, also in the third comparative example, the ink in the image portion is apt to permeate the inside of the continuous paper P.

In addition, also in a configuration (fourth comparative example) in which the number of driven ones of the irradiation arrays 84 in the second irradiation device 52 is kept in the first drying portion 50 of the exemplary embodiment while only the irradiation intensity of each irradiation array 84 is reduced, the time to increase the ink temperature to the target temperature in the image portion of the continuous paper P becomes long in the same manner as in the first comparative example. Therefore, also in the fourth comparative example, the ink in the image portion is apt to permeate the inside of the continuous paper P.

On the other hand, in the exemplary embodiment, as described previously, when the low-rate mode is selected as the feeding rate of the continuous paper P, the number of driven ones of the irradiation arrays 84 in each irradiation unit 80 of the second irradiation device 52 is reduced. As a result, the irradiation range along the feeding direction A in each irradiation unit 80 of the second irradiation device 52 is reduced, and the irradiation time of laser light from the second irradiation device 52 toward the continuous paper P is reduced in accordance with the reduction of the irradiation range along the feeding direction A. Thus, according to the exemplary embodiment, irradiation with laser light in a short time can be performed in a state where the irradiation intensity of each irradiation array 44 is kept high, in comparison with the first comparative example, the third comparative example and the fourth comparative example.

In this manner, irradiation with laser light in a short time is performed in a state where the irradiation intensity of each irradiation array 44 is kept high, so that the time to increase the ink temperature to the target temperature in the image portion of the continuous paper P is shortened (see the solid line T in FIG. 18) in comparison with the first comparative example, the third comparative example and the fourth comparative example. Thus, the permeation of the ink from the image portion to the inside of the continuous paper P is suppressed (see the broken line S in FIG. 18). Accordingly, the coloring agent of the ink is also suppressed from permeating the inside of the continuous paper P, and deterioration of the image density is suppressed.

Figure 18:
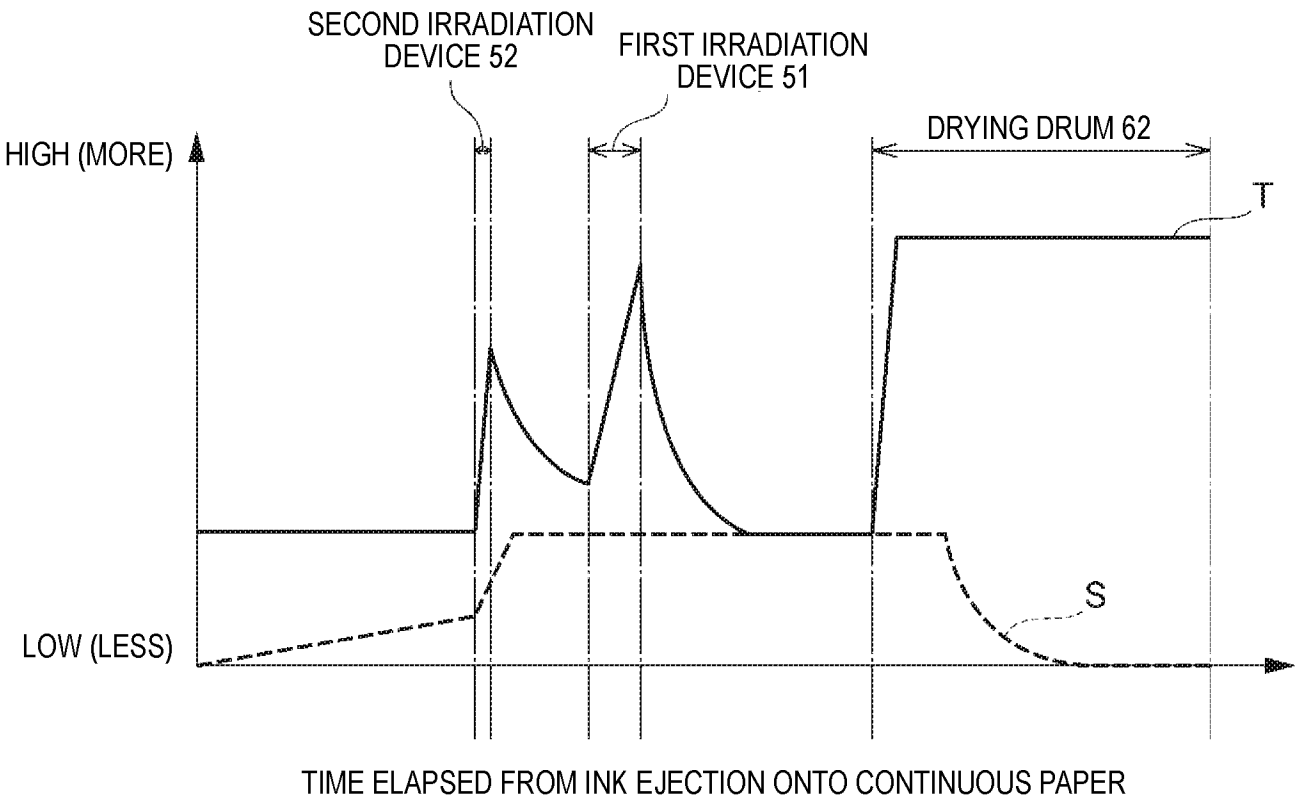
FIG. 18 is a graph showing a change of ink temperature in an image portion of continuous paper P in a case where the first drying portion according to the exemplary embodiment is used.

In FIG. 18, the solid line T designates the ink temperature in the image portion of the continuous paper P, and the broken line S designates the quantity of ink permeating the continuous paper P, in the same manner as in FIG. 17. As illustrated in FIG. 18, the time to increase the ink temperature to the target temperature in the second irradiation device 52 is shorter than the time to increase the ink temperature to the target temperature in the first irradiation device 51.

In addition, according to the exemplary embodiment, when the low-rate mode is selected, the irradiation intensity of each irradiation array 84 to be turned on is reduced in addition to the configuration in which the number of driven ones of the irradiation arrays 84 is reduced in each irradiation unit 80. Specifically, according to the exemplary embodiment, when the low-rate mode is selected, of the irradiation arrays 84 to be turned on, the irradiation intensity of the irradiation arrays 84 on the downstream side in the feeding direction is reduced. Thus, the irradiation intensity of each irradiation array 84 to be turned on is reduced so that fine adjustment is easily performed on the irradiation energy to the continuous paper P, in comparison with a configuration (fifth comparative example) in which the irradiation intensity of each irradiation array 84 is kept while only the number of driven ones of the irradiation arrays 84 is reduced. In addition, according to the exemplary embodiment, of the irradiation arrays 84 to be turned on, the irradiation intensity of the irradiation arrays 84 on the downstream side in the feeding direction is reduced so that the time to increase the ink temperature to the target temperature in the image portion of the continuous paper P is shortened, in comparison with a configuration (sixth comparative example) in which, of the irradiation arrays 84 to be turned on, the irradiation intensity of the irradiation arrays 84 on the upstream side in the feeding direction is reduced. As a result, the ink in the image portion is suppressed from permeating the inside of the continuous paper P.

In addition, according to the exemplary embodiment, as described previously, when the low-rate mode is selected, the irradiation intensity of each irradiation array 84 on the downstream side in the feeding direction is reduced so that, of the irradiation arrays 84, the irradiation intensity of each irradiation array 84 on the upstream side in the feeding direction is made not lower than the irradiation intensity of each irradiation array 84 on the downstream side in the feeding direction. Thus, the time to increase the ink temperature to the target temperature in the image portion of the continuous paper P is shortened in comparison with a configuration (seventh comparative example) in which, of the irradiation arrays 84, the irradiation intensity of each irradiation array 84 on the downstream side in the feeding direction is made higher than the irradiation intensity of each irradiation array 84 on the upstream side in the feeding direction. As a result, the ink in the image portion is suppressed from permeating the inside of the continuous paper P.

Further, according to the exemplary embodiment, as described previously, when the low-rate mode is selected, the irradiation intensity of each irradiation array 84 on the downstream side in the feeding direction is reduced so that, of the irradiation arrays 84, the irradiation intensity of the most upstream irradiation array 84 in the feeding direction is made highest. Thus, the time to increase the ink temperature to the target temperature in the image portion of the continuous paper P is shortened in comparison with a configuration (eighth comparative example) in which, of the irradiation arrays 84, the irradiation intensity of the most downstream irradiation array 84 in the feeding direction is made highest. As a result, the ink in the image portion is suppressed from permeating the inside of the continuous paper P.

In addition, the number of driven ones of the irradiation arrays 84 and the irradiation intensity of each irradiation array 84 in the second irradiation device 52 are set so that the cumulative energy of laser light with which the continuous paper P is irradiated from the second irradiation device 52 is not higher than the upper limit energy set in advance for each kind of continuous paper P.

Thus, excessive irradiation of the continuous paper P with laser light is suppressed independently of the kind of continuous paper P, in comparison with a configuration (ninth comparative example) in which the number of driven ones of the irradiation arrays 84 and the irradiation intensity of each irradiation array 84 are set so that the cumulative energy is not higher than the upper limit energy set in advance independently of the kind of continuous paper P. As a result, occurrence of wrinkles in the continuous paper P is suppressed. In addition, boiling of ink droplets due to the excessive irradiation with the laser light is suppressed.

In addition, according to the exemplary embodiment, the peak wavelength of laser light in each laser element 82 of the second irradiation device 52 is set at a wavelength in which the absorptivity in the non-image portion of the continuous paper P is 10% or less. Accordingly, excessive irradiation of the laser light to the non-image portion of the continuous paper P is suppressed in comparison with a configuration (tenth comparative example) in which the peak wavelength of laser light in the second irradiation device 52 is a wavelength in which the absorptivity in the non-image portion of the continuous paper P exceeds 10%. As a result, occurrence of wrinkles in the continuous paper P is suppressed.

In addition, in the first irradiation device 51, the irradiation intensity of each irradiation array 44 is controlled in accordance with a distribution of image density in the widthwise direction W of the continuous paper P.

Accordingly, excessive irradiation and insufficient irradiation with laser light are suppressed even in an image pattern in which there is a distribution in the image density in the widthwise direction W of the continuous paper P. As a result, occurrence of wrinkles in the continuous paper P is suppressed.

In addition, the irradiation intensity of each irradiation array 44 in the first irradiation device 51 is changed in accordance with a change of density in an image passing through the irradiation region of the irradiation array 44.

Accordingly, excessive irradiation and insufficient irradiation with laser light are suppressed even in an image pattern in which there is a distribution in the image density in the feeding direction A of the continuous paper P. As a result, occurrence of wrinkles in the continuous paper P is suppressed.

(Modified Examples)

Figure 19:
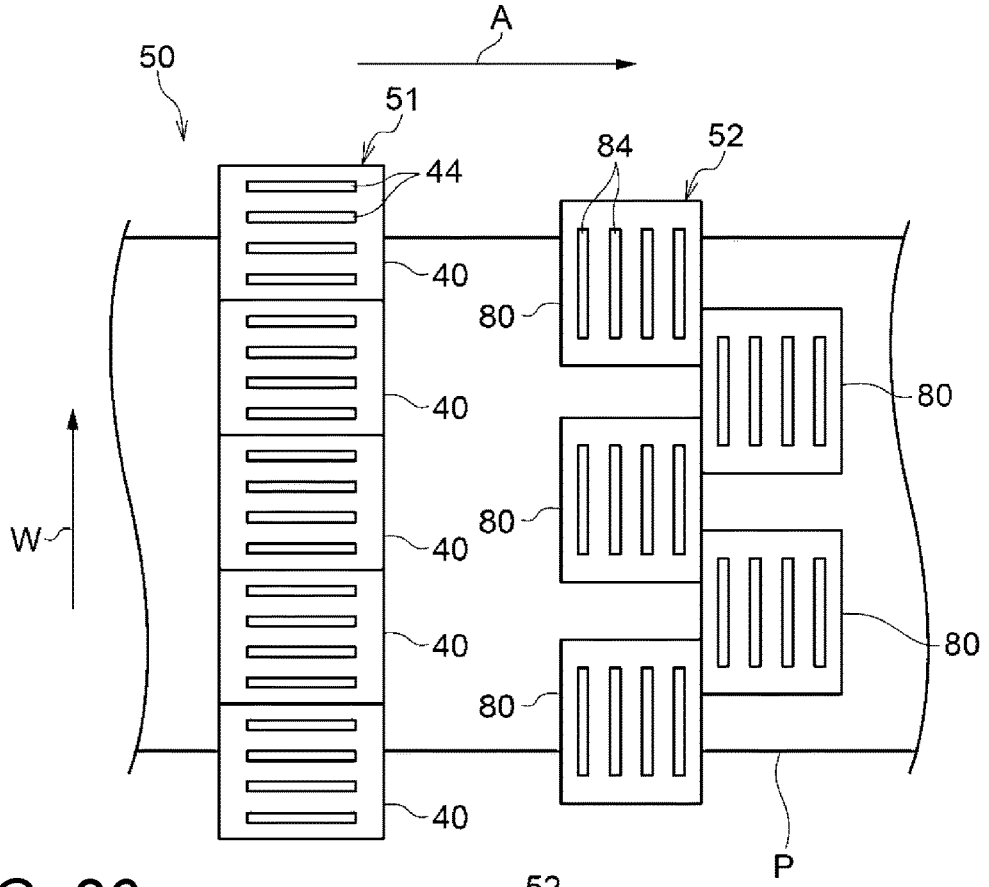
FIG. 19 is a configuration view showing a first modified example of a first drying portion.

Although the second irradiation device 52 is disposed on the upstream side in the feeding direction with respect to the first irradiation device 51 according to the exemplary embodiment, the invention is not limited thereto. For example, as illustrated in FIG. 19, the invention may have a configuration (first modified example) in which the first irradiation device 51 is disposed on the upstream side in the feeding direction with respect to the second irradiation device 52.

Figure 20:
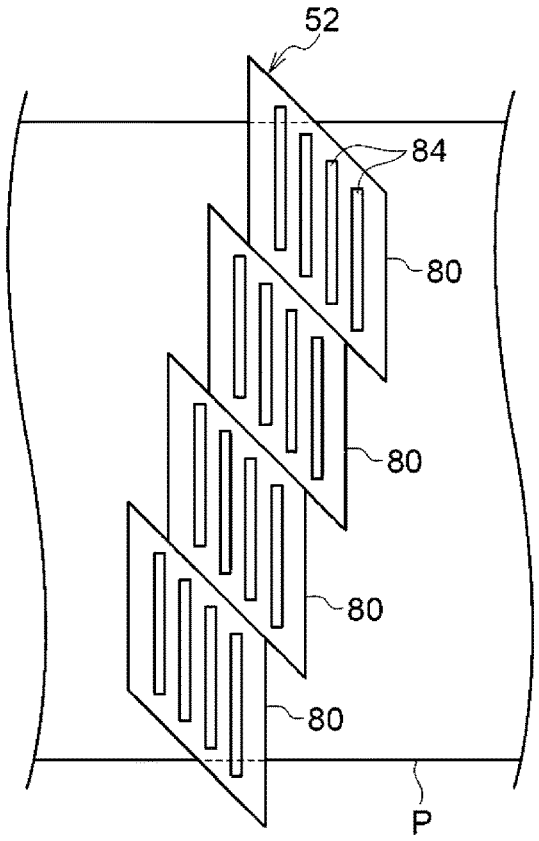
FIG. 20 is a configuration view showing a modified example of a second irradiation device.
Figure 21:
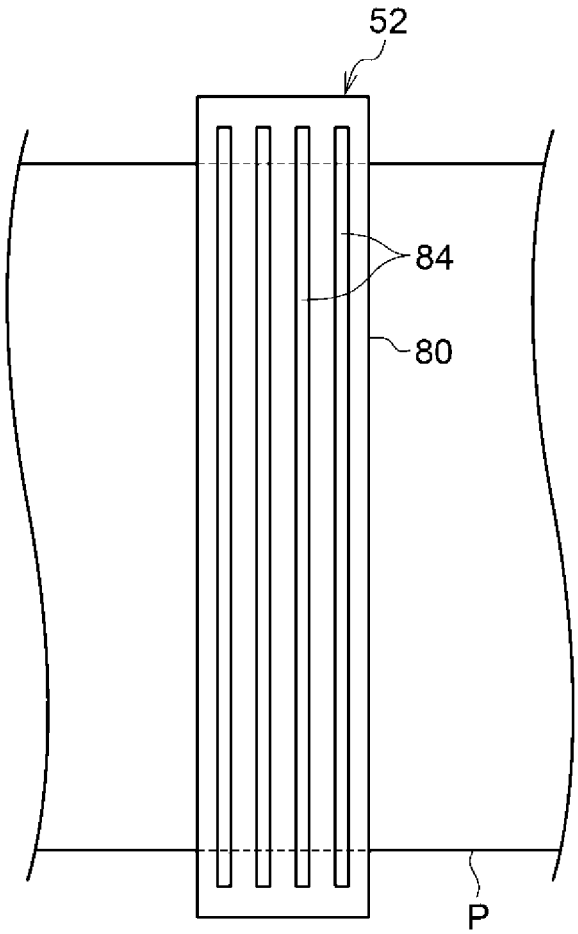
FIG. 21 is a configuration view showing another modified example of a second irradiation device.

In addition, the second irradiation device 52 may have a configuration of FIG. 20 or FIG. 21. In the configuration shown in FIG. 20, each irradiation unit 80 is formed into a parallelogram. Plural irradiation units 80 are disposed along the widthwise direction W. Further, the irradiation units 80 are disposed so that, of adjacent ones of the irradiation units 80 in the widthwise direction W, the irradiation unit 80 on one side (lower side in FIG. 20) in the widthwise direction W is displaced on the upstream side in the feeding direction with respect to the irradiation unit 80 on the other side (upper side in FIG. 20) of the widthwise direction W.

In addition, between adjacent ones of the irradiation units 80 in the widthwise direction W, as shown in FIG. 20, the irradiation arrays 84 are disposed without any space in the widthwise direction W. Specifically, in the second irradiation device 52, the irradiation arrays 84 are disposed to be overlapped in the widthwise direction W between adjacent ones of the irradiation units 80 in the widthwise direction W.

In the configuration shown in FIG. 21, the second irradiation device 52 is constituted by a single irradiation unit 80. In the irradiation unit 80, irradiation arrays 84 each having a length not shorter than the width of the continuous paper P in the widthwise direction W are arranged side by side in the feeding direction A.

According to the exemplary embodiment, when the low-rate mode is selected, the irradiation intensity of each irradiation array 84 to be turned on is reduced in addition to the configuration in which the number of driven ones of the irradiation arrays 84 is reduced. However, the invention is not limited thereto. For example, the invention may have a configuration in which, when the low-rate mode is selected, only the number of driven ones of the irradiation arrays 84 is reduced.

According to the exemplary embodiment, when the low-rate mode is selected, of the irradiation arrays 84 to be turned on, the irradiation intensity of each irradiation array 84 on the downstream side in the feeding direction is reduced. However, the invention is not limited thereto. For example, the invention may have a configuration in which the irradiation intensity of the irradiation arrays 84 to be turned on is reduced constantly within a predetermined allowable range. Alternatively, the invention may have a configuration in which, of the irradiation arrays 84 to be turned on, the irradiation intensity of each irradiation array 84 on the upstream side in the feeding direction is reduced.

According to the exemplary embodiment, when the low-rate mode is selected, of the irradiation arrays 84 to be turned on, the irradiation intensity of each irradiation array 84 on the upstream side in the feeding direction is made not lower than the irradiation intensity of each irradiation array 84 on the downstream side in the feeding direction. However, the invention is not limited thereto. For example, the irradiation intensity of the irradiation arrays 84 to be turned on may be fixed within a predetermined allowable range. Alternatively, the invention may have a configuration in which, of the irradiation arrays 84 to be turned on, the irradiation intensity of each irradiation array 84 on the downstream side in the feeding direction is made higher than the irradiation intensity of each irradiation array 84 on the upstream side in the feeding direction. Further, the invention may have a configuration in which, of the irradiation arrays 84 to be turned on, the irradiation intensity of each irradiation array 84 on the upstream side in the feeding direction is made not lower than the irradiation intensity of each irradiation array 84 on the downstream side in the feeding direction even when the normal mode is selected, that is, independently of the feeding rate of the continuous paper P.

According to the exemplary embodiment, when the low-rate mode is selected, of the irradiation arrays 84, the irradiation intensity of the most upstream irradiation array 84 in the feeding direction is made highest. However, the invention is not limited thereto. For example, the invention may have a configuration in which, of the irradiation arrays 84, the irradiation intensity of the intermediate irradiation array 84 in the feeding direction or the irradiation intensity of the most downstream irradiation array 84 in the feeding direction is made highest. Further, the invention may have a configuration in which, of the irradiation arrays 84, the irradiation intensity of the most upstream irradiation array 84 in the feeding direction is made highest even when the normal mode is selected, that is, independently of the feeding rate of the continuous paper P.

According to the exemplary embodiment, the number of driven ones of the irradiation arrays 84 and the irradiation intensity of each irradiation array 84 in the second irradiation device 52 are set so that the cumulative energy of laser light with which the continuous paper P is irradiated from the second irradiation device 52 is not higher than the upper limit energy set in advance for each kind of continuous paper P. However, the invention is not limited thereto. For example, the invention may have a configuration in which the number of driven ones of the irradiation arrays 84 and the irradiation intensity of each irradiation array 84 in the second irradiation device 52 are set so that the cumulative energy is not higher than an upper limit energy set independently of the kind of continuous paper P.

The invention is not limited to the aforementioned exemplary embodiment, but various modifications, changes or improvements can be made thereon without departing from the gist thereof. For example, plural the aforementioned modified examples may be combined and arranged suitably.

(Evaluation 1)

Evaluation was made about the relation between the peak wavelength (815 nm) of laser light and wrinkles in the continuous paper P. Transmissivity, reflectivity and absorptivity in various kinds of paper in the peak wavelength of the laser light are shown in the table of FIG. 22.

The transmissivity and the reflectivity in the table of FIG. 22 were measured by a spectrophotometer "U-4100" manufactured by Hitachi, Ltd. The absorptivity was calculated by "100-transmissivity-reflectivity". Alphabets in each field of paper in the table of FIG. 22 designate the name of the paper. "NIJ" designates "NPi Form NEXT-IJ (manufactured by Nippon Paper Industries, Co., Ltd.), and "OKT" designates "OK Top Coat Plus (Oji Paper Co., Ltd.). In addition, each numeric value in the field of paper designates a ream weight of the paper. For example, "55" designates "duodecimo ream weight of 55 kg".

As shown in the table of FIG. 22, the absorptivity was highest in paper "OKT63". Even when the paper "OKT63" was irradiated with laser light so that irradiation energy reached a value (for example, 5 J/cm$^2$) exceeding 1.5 times of required one (for example, 3 J/cm$^2$) for drying the image portion, there occurred no wrinkles in the paper. Incidentally, 1.5 times of the absorptivity of 6.8% in "OKT63" corresponds to 10.2%. That is, it was proved that no wrinkles occur even when the absorptivity reaches 10.2%. In addition, it could be also confirmed that no wrinkles occur as long as the peak wavelength of the laser light is within a range not shorter than 650 nm and not longer than 1,100 nm.

(Evaluation 2)

Quality evaluation was performed in the first drying portion 50 according to the exemplary embodiment (see FIG. 2), the first drying portion 50 according to the modified example 1 (see FIG. 19), the first drying portion 50 according to the first comparative example (see FIG. 7), and the first drying portion 50 according to the second comparative example (see FIG. 12). The evaluation was performed about the existence/absence of wrinkles in the image portion and the non-image portion, and the image density in the low-rate mode.

The image density was evaluated on the following conditions.

Evaluation method: measurement of optical density using reflection densitometer "x-Rite 504"

Evaluation conditions

Feeding rate of continuous paper P: 20 m/min (low-rate mode)

Continuous paper P: NPi Form Next-IJ 70 kg

Image density: 100% (each color)

Evaluation criterion

A: 1.1 or more

B: less than 1.1

The existence/absence of occurrence of wrinkles in the image portion and the non-image portion was evaluated on the following conditions.

Evaluation method: evaluation by visual observation and finger touch in comparison with grade samples (image portion and non-image portion)

Evaluation conditions

Feeding rate of continuous paper P: 20 m/min

Continuous paper P: OK Top Coat Plus 73 kg

Image density: 200% (each color)

Image pattern: image of repetition of 3-inch square image (image portion) and 3-inch square blank (non-image portion)

Evaluation criterion

A: grade 2.5 or less (existence of irregularities in visual observation but absence of irregularities in finger touch)

B: grade 3 or more (existence of irregularities in visual observation and existence of irregularities in finger touch)

As a result, as shown in FIG. 23, the first drying portion (see FIG. 2) according to the exemplary embodiment was evaluated as A in each evaluation about the existence/absence of occurrence of wrinkles and the image density in the low-rate mode. The first drying portion 50 (see FIG. 19) according to the first modified example was evaluated as A about the existence/absence of occurrence of wrinkles but as B in any evaluation about the image density in the low-rate mode. The first drying portion 50 (see FIG. 7) according to the first comparative example and the first drying portion 50 (see FIG. 12) according to the second comparative example were evaluated as B in any evaluation about the existence/absence of occurrence of wrinkles and the image density in the low-rate mode.

What is claimed is:

1. A drying unit comprising:

a first irradiation device that comprises a plurality of first irradiation arrays each having a plurality of laser elements disposed along a feeding direction of a recording medium to which liquid droplets have been ejected and which is being fed, the recording medium being irradiated with laser light by the laser elements, the first irradiation arrays being disposed side by side in a cross direction crossing the feeding direction, driving of the first irradiation device being controlled for each of the first irradiation arrays; and a second irradiation device that is provided on an upstream side or a downstream side in the feeding direction with respect to the first irradiation device, the second irradiation device comprising a plurality of irradiation units each having a plurality of second irradiation arrays, the second irradiation arrays each having a plurality of laser elements disposed along the cross direction, the recording medium being irradiated with laser light by the laser elements, the irradiation units being disposed zigzag along the cross direction, the second irradiation arrays being disposed side by side in the feeding direction, driving of the second irradiation device being controlled for each of the second irradiation arrays.

2. The drying unit according to claim 1, wherein:

the second irradiation device is provided on the upstream side in the feeding direction with respect to the first irradiation device.

3. The drying unit according to claim 2, wherein:

number of driven ones of the second irradiation arrays in the second irradiation device is reduced when a feeding rate of the recording medium is set at a low rate.

4. The drying unit according to claim 3, wherein:

irradiation intensity of each of the second irradiation arrays in the second irradiation device is reduced when the feeding rate of the recording medium is set at the low rate.

5. The drying unit according to claim 4, wherein:

of the second irradiation arrays in the second irradiation device, the irradiation intensity of each of the second irradiation arrays on the downstream side in the feeding direction is reduced when the feeding rate of the recording medium is set at the low rate.

6. The drying unit according to claim 1, wherein:

of the second irradiation arrays in the second irradiation device, irradiation intensity of each of the second irradiation arrays on the upstream side in the feeding direction is made not lower than irradiation intensity of each of the second irradiation arrays on the downstream side in the feeding direction.

7. The drying unit according to claim 2, wherein:

of the second irradiation arrays in the second irradiation device, irradiation intensity of each of the second irradiation arrays on the upstream side in the feeding direction is made not lower than irradiation intensity of each of the second irradiation arrays on the downstream side in the feeding direction.

8. The drying unit according to claim 3, wherein:

of the second irradiation arrays in the second irradiation device, irradiation intensity of each of the second irradiation arrays on the upstream side in the feeding direction is made not lower than irradiation intensity of each of the second irradiation arrays on the downstream side in the feeding direction.

9. The drying unit according to claim 6, wherein:

of the second irradiation arrays in the second irradiation device, irradiation intensity of most upstream second irradiation array in the feeding direction is made highest.

10. The drying unit according to claim 1, wherein:

number of driven ones of the second irradiation arrays and irradiation intensity of each of the second irradiation arrays in the second irradiation device are set so that cumulative energy of the laser light with which the recording medium is irradiated is not higher than upper limit energy set in advance for each kind of recording medium.

11. The drying unit according to claim 2, wherein:

number of driven ones of the second irradiation arrays and irradiation intensity of each of the second irradiation arrays in the second irradiation device are set so that cumulative energy of the laser light with which the recording medium is irradiated is not higher than upper limit energy set in advance for each kind of recording medium.

12. The drying unit according to claim 3, wherein:

number of driven ones of the second irradiation arrays and irradiation intensity of each of the second irradiation arrays in the second irradiation device are set so that cumulative energy of the laser light with which the recording medium is irradiated is not higher than upper limit energy set in advance for each kind of recording medium.

13. The drying unit according to claim 1, wherein:

a peak wavelength of the laser light in the second irradiation device is a wavelength in which absorptivity in a part of the recording medium where no liquid droplets have been ejected is 10% or less.

14. The drying unit according to claim 2, wherein:

a peak wavelength of the laser light in the second irradiation device is a wavelength in which absorptivity in a part of the recording medium where no liquid droplets have been ejected is 10% or less.

15. The drying unit according to claim 3, wherein;

a peak wavelength of the laser light in the second irradiation device is a wavelength in which absorptivity in a part of the recording medium where no liquid droplets have been ejected is 10% or less.

16. The drying unit according to claim 1, wherein;

an image is formed onto the recording medium by the liquid droplets; and irradiation intensity of each of the first irradiation arrays in the first irradiation device is changed in accordance with a change of density in an image passing through an irradiation region of the first irradiation array.

17. The drying unit according to claim 2, wherein:

an image is formed onto the recording medium by the liquid droplets; and irradiation intensity of each of the first irradiation arrays in the first irradiation device is changed in accordance with a change of density in an image passing through an irradiation region of the first irradiation array.

18. The drying unit according to claim 3, wherein:

an image is formed onto the recording medium by the liquid droplets; and irradiation intensity of each of the first irradiation arrays in the first irradiation device is changed in accordance with a change of density in an image passing through an irradiation region of the first irradiation array.

19. An ejection device comprising:

a feeding portion that feeds a recording medium;

an ejection portion that ejects liquid droplets onto the recording medium, so that a distribution is able to be produced in quantity of the liquid droplets within an irradiation range of the first irradiation arrays along a feeding direction of the recording medium and an irradiation range of the second irradiation arrays along a cross direction crossing the feeding direction; and the drying unit according to claim 1, the drying unit drying the recording medium to which the liquid droplets have been ejected.

* * * * *